US011767162B2

(12) United States Patent
Ford, III

(10) Patent No.: US 11,767,162 B2
(45) **Date of Patent: *Sep. 26, 2023**

(54) MODULAR FACILITY FORMATION SYSTEM AND SHIPPING METHOD

(71) Applicant: Irish Dawg Industries, LLC, Stuart, FL (US)

(72) Inventor: Harry Ralph Ford, III, Stuart, FL (US)

(73) Assignee: Irish Dawg Industries, LLC, Stuart, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/675,845

(22) Filed: Feb. 18, 2022

(65) Prior Publication Data

US 2022/0169442 A1 Jun. 2, 2022

Related U.S. Application Data

(63) Continuation of application No. 16/824,941, filed on Mar. 20, 2020, now Pat. No. 11,254,494.
(Continued)

(51) Int. Cl.
*B65D 90/00* (2006.01)
*B65D 88/12* (2006.01)

(52) U.S. Cl.
CPC ..... *B65D 90/004* (2013.01); *B65D 88/121* (2013.01); *B65D 90/006* (2013.01);
(Continued)

(58) Field of Classification Search
CPC . E04H 1/125; E04H 2001/1283; E04B 1/348; E04B 1/34861; B65D 90/004;
(Continued)

(56) References Cited

U.S. PATENT DOCUMENTS 2,499,498 A * 3/1950 Hammond, Jr. ..... E04H 1/005 414/277
3,553,823 A 1/1971 Torsten
(Continued)

FOREIGN PATENT DOCUMENTS

CA 2854516 5/2015
DE 202009002015 U1 8/2010
(Continued)

OTHER PUBLICATIONS

Final Office Action, dated Nov. 23, 2021, from corresponding U.S. Appl. No. 17/214,050.
(Continued)

*Primary Examiner* — Christine T Cajilig
(74) *Attorney, Agent, or Firm* — Brient IP Law, LLC

(57) ABSTRACT

A modular facility formation system includes any number of modules that may be coupled to one another to create a facility. Walls of the facility may be provided by one or more removeable walls, the walls of a shipping container, or a combination thereof. When installed within a shipping container, upper and lower braces are pressure fit into the shipping container without penetrating the container. The lower braces are configured to engage guidance mechanisms of the modules to guide the modules into a stowage position within the shipping container and to secure the modules in place. The modules may be configured with a pre-determined internal configuration corresponding to a defined function of the room within the facility.

20 Claims, 39 Drawing Sheets

Related U.S. Application Data

(60) Provisional application No. 62/827,831, filed on Apr. 1, 2019.

(52) U.S. Cl.
CPC ..... *B65D 90/008* (2013.01); *B65D 90/0073* (2013.01); *B65D 88/127* (2013.01); *B65D 2590/0066* (2013.01)

(58) Field of Classification Search
CPC ..... B65D 90/0046; B65D 90/006; B65D 90/0066; B65D 90/0073; B65D 90/008; B65D 88/121; B65D 88/127
See application file for complete search history.

(56) References Cited

U.S. PATENT DOCUMENTS 3,623,296 A * 11/1971 Santoro ..... E04B 1/34807 D25/4
3,754,516 A 8/1973 Van Gompel
3,963,290 A 6/1976 Rennemann
4,049,149 A 9/1977 Durenec
4,305,505 A * 12/1981 Hickey ..... B65D 19/38 206/599
4,521,941 A 6/1985 Gerhard
4,766,708 A * 8/1988 Sing ..... E04B 1/98 52/167.2
4,875,814 A 10/1989 Weller
4,910,932 A * 3/1990 Honigman ..... E04B 1/08 52/282.4
5,072,845 A 12/1991 Grogan
5,171,113 A 12/1992 Hove
5,706,614 A * 1/1998 Wiley, Jr ..... E04B 1/3483 52/537
6,105,511 A 8/2000 Bridges
6,220,468 B1 4/2001 Lee
7,185,779 B2 3/2007 Payne
7,507,061 B2 3/2009 Wells et al.
D625,529 S * 10/2010 Grainger ..... D6/675.5
7,823,338 B2 11/2010 Slagel et al.
8,066,134 B2 11/2011 Davidson
8,556,112 B2 10/2013 Tujague, Sr. et al.
8,763,314 B2 7/2014 Yoo
8,881,934 B2 11/2014 Tujague, Sr. et al.
9,422,083 B1 8/2016 Embleton et al.
9,499,334 B2 11/2016 Aldo
9,617,748 B2 4/2017 Wilson et al.
9,966,739 B2 5/2018 Chen et al.
10,340,697 B2 7/2019 Paine et al.
10,549,908 B2 2/2020 Kochanowski
10,704,251 B1 * 7/2020 Rubier ..... E04B 1/34815
10,865,040 B2 12/2020 Oltman et al.
2003/0170111 A1 * 9/2003 Gohlke ..... B65D 88/126 414/800
2005/0193643 A1 * 9/2005 Pettus ..... F24F 3/167 52/79.1
2007/0056967 A1 * 3/2007 Dobrinski ..... B65D 11/1826 220/6
2008/0250726 A1 * 10/2008 Slagel ..... G01V 5/0008 52/79.8
2009/0032530 A1 2/2009 Chu
2009/0084800 A1 4/2009 Hartley et al.
2010/0089917 A1 * 4/2010 Gilbert ..... B65D 88/12 493/405
2010/0147842 A1 * 6/2010 Reynard ..... B65D 88/022 220/23.88
2010/0191615 A1 * 7/2010 Thomas ..... B65D 90/008 52/27
2011/0303661 A1 * 12/2011 Tujague, Sr ..... B65D 90/006 220/23.88
2012/0006369 A1 * 1/2012 Cantin ..... E04B 1/3444 135/96
2013/0180182 A1 * 7/2013 Yoo ..... F24S 25/13 52/27
2016/0101931 A1 * 4/2016 Disorbo ..... B65D 90/02 220/1.5
2016/0312485 A1 * 10/2016 Wilson ..... E04B 5/48
2017/0244225 A1 * 8/2017 Chen ..... A47B 53/00
2018/0050862 A1 2/2018 Wu et al.
2018/0109163 A1 * 4/2018 Paine ..... E04H 5/04
2018/0237216 A1 8/2018 Saer
2019/0177976 A1 * 6/2019 Wakiyama ..... B21H 3/02
2020/0154596 A1 * 5/2020 Roy ..... H05K 7/1497
2021/0198888 A1 * 7/2021 Unger ..... E04H 1/005

FOREIGN PATENT DOCUMENTS

DE 202013012030 U1 12/2014
DE 102017111609 B3 10/2018
FR 1291776 A 4/1962
GB 2415444 A 12/2005
WO 2009105050 A1 8/2009
WO 2014128120 A2 8/2014

OTHER PUBLICATIONS

Notice of Allowance, dated Jul. 14, 2021, from corresponding U.S. Appl. No. 17/214,063.
Notice of Allowance, dated Mar. 19, 2021, from corresponding U.S. Appl. No. 16/824,952.
Notice of Allowance, dated Oct. 6, 2021, from corresponding U.S. Appl. No. 16/824,941.
Office Action, dated Apr. 5, 2021, from corresponding U.S. Appl. No. 16/824,941.
Office Action, dated Jul. 14, 2021, from corresponding U.S. Appl. No. 17/214,050.
Office Action, dated Nov. 13, 2020, from corresponding U.S. Appl. No. 16/824,952.
Office Action, dated Nov. 9, 2020, from corresponding U.S. Appl. No. 16/824,945.
Office Action, dated Oct. 29, 2020, from corresponding U.S. Appl. No. 16/824,941.
Restriction Requirement, dated Aug. 7, 2020, from corresponding U.S. Appl. No. 16/824,945.
Restriction Requirement, dated Jul. 2, 2020, from corresponding U.S. Appl. No. 16/824,952.
Restriction Requirement, dated May 29, 2020, from corresponding U.S. Appl. No. 16/824,941.
Office Action, dated Sep. 29, 2022, from corresponding U.S. Appl. No. 17/521,272.
Notice of Allowance, dated Jan. 25, 2023, from corresponding U.S. Appl. No. 17/521,272.

* cited by examiner

MODULAR FACILITY FORMATION SYSTEM AND SHIPPING METHOD

CROSS-REFERENCE TO RELATED APPLICATIONS

This application is a continuation of U.S. patent application Ser. No. 16/824,941, filed Mar. 20, 2020, and entitled "MODULAR FACILITY FORMATION SYSTEM AND SHIPPING METHOD," which claims the benefit of U.S. Provisional Patent Application No. 62/827,831, filed on Apr. 1, 2019, and entitled "MODULAR CONTAINER INSERT SYSTEM AND SHIPPING METHOD," the disclosures of which are hereby incorporated by reference herein in their entirety.

BACKGROUND

Standardized shipping containers are commonly used throughout the world for shipping goods and cargo by sea, land, and rail. These containers are referred to as ISO (International Organization for Standardization) containers, freight containers, ISBUs (Inter-modal Steel Building Unit) when used for non-shipping purposes, among other names. Shipping containers are typically configured in standard sizes, including 10 feet, 20 feet, and 40 feet in length. Because shipping regulations do not allow for cargo to be bolted to the containers (containers may not be penetrated), contents are often subject to movement within the storage space during transit from one location to another. The inability to adequately secure cargo within the container, or the time and additional materials used to carefully pack cargo to avoid movement without securing the cargo to the container, creates the potential for damage to the cargo being shipped and/or excessive costs in preparing the shipment.

In addition, there is a need for military, humanitarian, and other organizations to be able to set up mobile or temporary operations quickly and effectively. Doing so entails shipping the necessary equipment and infrastructure to a desired location and setting up the equipment and corresponding structures to allow personnel to store equipment and other property, and/or work in a protected environment in an efficient manner. Often tents must be used or structures fabricated. Alternatively, such equipment or systems may be permanently integrated with a container in order to make it transportable in this fashion, but this manufacturing method presents significant technological complexity and expense. Consequently, there is a need for improved cargo securement systems and methods, and for improved facility and operations establishment systems and methods. Various embodiments of the present modular facility formation system recognize and address the foregoing considerations, and others, of prior art devices.

SUMMARY

It should be appreciated that this Summary is provided to introduce a selection of concepts in a simplified form that are further described below in the Detailed Description. This Summary is not intended to be used to limit the scope of the claimed subject matter.

According to one aspect of the disclosure, a modular facility formation system for providing a facility using a container configured for land, sea, and rail transport is provided. The system includes one or more modules and a number of braces. Each module includes a framework sized according to an interior space of the container, a floor system coupled to the framework, and a guidance mechanism configured to guide the module into a stowage position within the container. The braces are configured to abut one or more inside surfaces of the container and engage the guidance mechanism of the modules to guide the module into the container along a longitudinal axis while preventing movement of the module along a horizontal axis and along a vertical axis.

According to another aspect, a modular facility formation system is provided for creating a facility. The system includes one or more modules. Each module includes a framework sized according to an interior space of the container, a floor system coupled to the framework, and a guidance mechanism configured to guide the module into a stowage position within the container. Connectors are configured for electrical or communicative coupling with an adjacent module. The system additionally includes means for restricting access through one or more sides of the module.

According to a further aspect of the disclosure, a modular facility formation system is provided. The system includes a number of modules, each module configured to couple to other modules to create a facility. Each module includes a framework, a floor system coupled to the framework, and a pre-determined internal configuration corresponding to a defined function of a room of the facility. Connectors are configured for electrical or communicative coupling with an adjacent module.

BRIEF DESCRIPTION OF THE DRAWINGS

Various embodiments of the invention will be described below. In the course of the description, reference will be made to the accompanying drawings, which are not necessarily drawn to scale, and wherein.

DETAILED DESCRIPTION OF VARIOUS EMBODIMENTS

Figure 1:
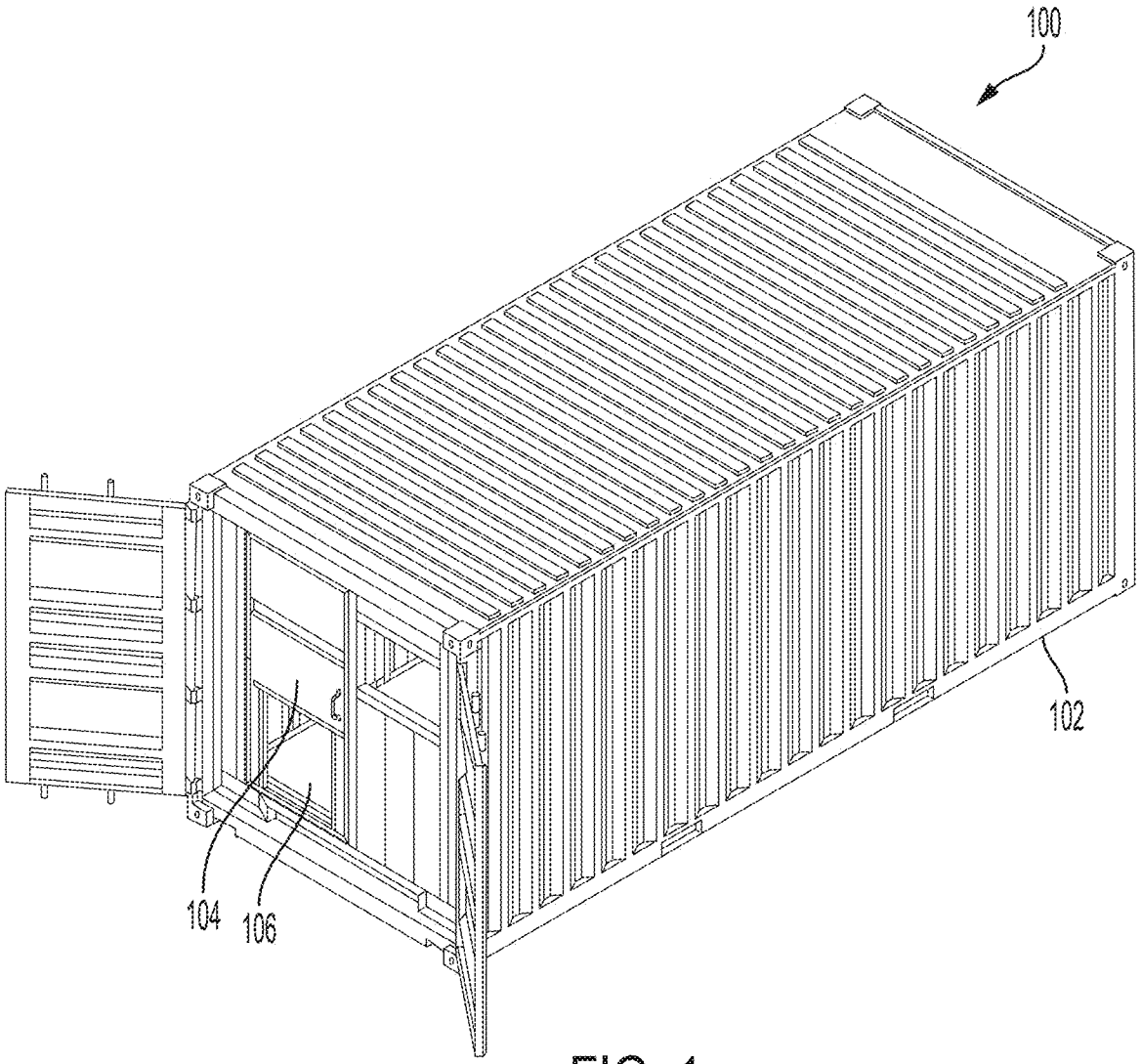
FIG. 1 is a perspective view of a modular facility formation system and cargo securement system according to various embodiments described below.

Various embodiments now will be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As discussed above, standardized shipping containers are commonly used throughout the world for shipping cargo. For the purposes of this disclosure, the term "shipping container" is used to generally cover any type of standardized shipping or freight container that is commonly utilized in the industry for shipping cargo by sea, land, and/or rail, as well as for use in non-shipping applications. Adequately securing cargo within a shipping container without penetrating the container walls or structure is problematic, as additional materials and excessive time is required, leading to increased shipping costs.

Additionally, there is a need for military, humanitarian, and other organizations to efficiently establish mobile or temporary operations. Doing so can be time consuming, cumbersome, and costly, as the necessary equipment and infrastructure is carefully packed into shipping containers at the point of origin, unloaded at the destination, stored or staged until temporary facilities are built and properly configured, and then unpacked and positioned within the temporary facilities. Alternatively, such equipment or facilities may be permanently integrated with or constructed as a container in order to accomplish the goal of transportability, but this manufacturing method presents significant technological complexity and expense, which is often unnecessary to accomplish the goal of transportability.

Utilizing the concepts and techniques described herein, a cargo securement system and modular facility formation system is utilized with standard shipping containers to provide a secure system and method for shipping cargo such as equipment and materials, as well as to provide effective work and storage spaces upon arrival at the destination. According to various embodiments, one or more modules provide the flooring and framework for secure shipment within a shipping container, as well for a facility that may be created using the shipping container as one or more walls and ceiling that surround the module. The modules are sized to allow for one or more rooms within a single shipping container. One or more removable walls allow for ingress and egress of a module or between modules within a shipping container.

According to various embodiments, modules may be coupled together to create a facility of any desired size. Exterior facing walls of any connected modules may be covered with one or more removable walls to create facility walls, or the exterior walls of a shipping container may provide the facility walls. Modules may include any desired electrical and/or data systems. The electrical and data systems may include any circuitry, electrical pathways, data pathways, network components, one or more power sources, and corresponding connectors to electrically and/or communicatively couple adjacent modules or the facility defined by the corresponding modules to one or more external power sources and data networks. In this manner, modules may be electrically and/or communicatively coupled to create a network for exchanging electrical signals and/or data between modules, between components within the modules, and between the facility and external networks or power systems. Modules may be configured according to predetermined layouts or arrangements of cargo such as equipment, tools, furniture, storage, electrical and data input and output component placement and capacity, and any other components or structures required or desired for a designed function or mission of the module and/or facility of which the module is included.

For example, one module may be configured with the applicable electrical wiring and components, racks, cabinets, and equipment applicable to a battery maintenance or storage room for storing and/or testing and charging batteries. A second module may be configured with applicable furniture, work space, and equipment for a maintenance shop. For the purposes of other non-inclusive examples, a module could be configured with the applicable furniture, work space, and equipment for petroleum oil and lubricant storage and maintenance activities, a glycol recycling and generation facility, a milling and machining shop, fabrication and welding shop, small arms repair, hydraulic fabrication and repair, mobile water treatment, mobile solar power facility, and general maintenance facility. It should be understood that modules may include any number and type of predetermined internal configurations corresponding to the defined function of the room that the module will create within a facility defined by coupled or adjacent modules.

Moreover, modules may additionally or alternatively provide a cargo securement system that facilitates stowage, movement, and securement of cargo within a shipping container. Modules described herein may be generically configured to stow and secure cargo on the treadplate of the module, after which the module with cargo is maneuvered into a shipping container and secured into place using the braces and bracing rods described herein. The modules may also be configured to stow specialized equipment or cargo in a specialized configuration. For example, as discussed above, a module may be arranged according to a predetermined internal configuration corresponding to the defined function of the room that the module will create within the facility defined by coupled or adjacent modules. In this manner, the equipment, furniture, and various components of the room defined by the module may be considered cargo that is able to be maneuvered into a shipping container and secured into place using the braces and bracing rods described herein. For the purposes of this disclosure, "cargo" may include any materials secured to or within a module, and such module could perform this functionality with or without added electrical configurations.

It will become clear from the disclosure below that the systems described herein include at least two primary benefits. First, the disclosed systems provide a modular facility formation system used to create a mobile, configurable facility from any number of modules having one or more pre-determined internal configurations in conjunction with a shipping container or one or more removable walls. Second, the disclosed systems provide a cargo securement system used to secure cargo within a shipping container with a combination of optional configuration or furniture and equipment on or incorporated into the module itself, and braces and bracing rods to hold the braces in place within a shipping container, which secure a corresponding module with cargo in place within the shipping container, without utilizing bolts or any mechanism or process that requires penetrating the walls of the shipping container. Since the components of the systems remain the same in both systems, the terms "modular facility formation system" and "cargo securement system" will be used interchangeably within this disclosure.

Because securing cargo within a shipping container without penetrating the container structure is important in the shipping industry, according to one embodiment, upper and lower braces are used with corresponding bracing rods to frictionally fit or position the braces between opposing walls of a shipping container (e.g., between the ceiling and the floor of the container). The upper and lower braces are configured to engage components of the modules to secure the modules in place within a shipping container. In this manner, the modules are quickly and easily secured within a shipping container using pressure and friction, without damaging or altering any portion of the shipping container.

According to an alternative embodiment, a module bracing system is self-contained within or mounted to each module so that separate upper and lower braces and corresponding bracing rods are not utilized. According to this embodiment, each module has extendable lower braces that extend outward from a floor system of the module to apply pressure to the walls of the container and secure the module in place. Each module may additionally or alternatively have a number of extendable upper braces that pivot in place and extend to apply pressure to a beam, structural component, walls, and/or ceiling of the container to secure or support the module in place within the container.

Utilizing the bracing systems disclosed herein, equipment and other components being shipped may be secured within or to the module(s) using any desirable mechanism. In this manner, the modules having the desired equipment and components may be slid into the container for shipment with a forklift or any conventional transportation and shipping equipment or vehicle.

Turning now to FIG. 1, a modular facility formation system, or cargo securement system, 100 is shown. According to this embodiment, the shipping container 102 is a standard ISO certified series 1 freight container that is 8 feet wide, 8 feet 6 inches high, and 20 feet long, but it should be appreciated that any standard container may be used without departing from the scope of this disclosure. Any difference in length of the shipping container 102 will alter the maximum number of modules that may be secured within (e.g., 20 ft vs 40 ft accommodates 2 vs 4 modules), and in some instances where the container is smaller than 10 feet long (e.g., 8 feet 6 inches high), the dimensions of the module. The shipping container includes one or more modules 106 within. According to one embodiment, the module 106 closest to the container door has a removable wall 104 that provides a wall for the module 106, while allowing for any number of doors, windows, other openings, and/or hardware for attaching components to the modular facility formation system 100 (or facility or temporary facility). For example, the removable wall 104 may include a door for ingress and egress to the modular facility formation system 100. The removable wall 104 will be described in further detail below with respect to FIGS. 16A-18B.

Figure 2:
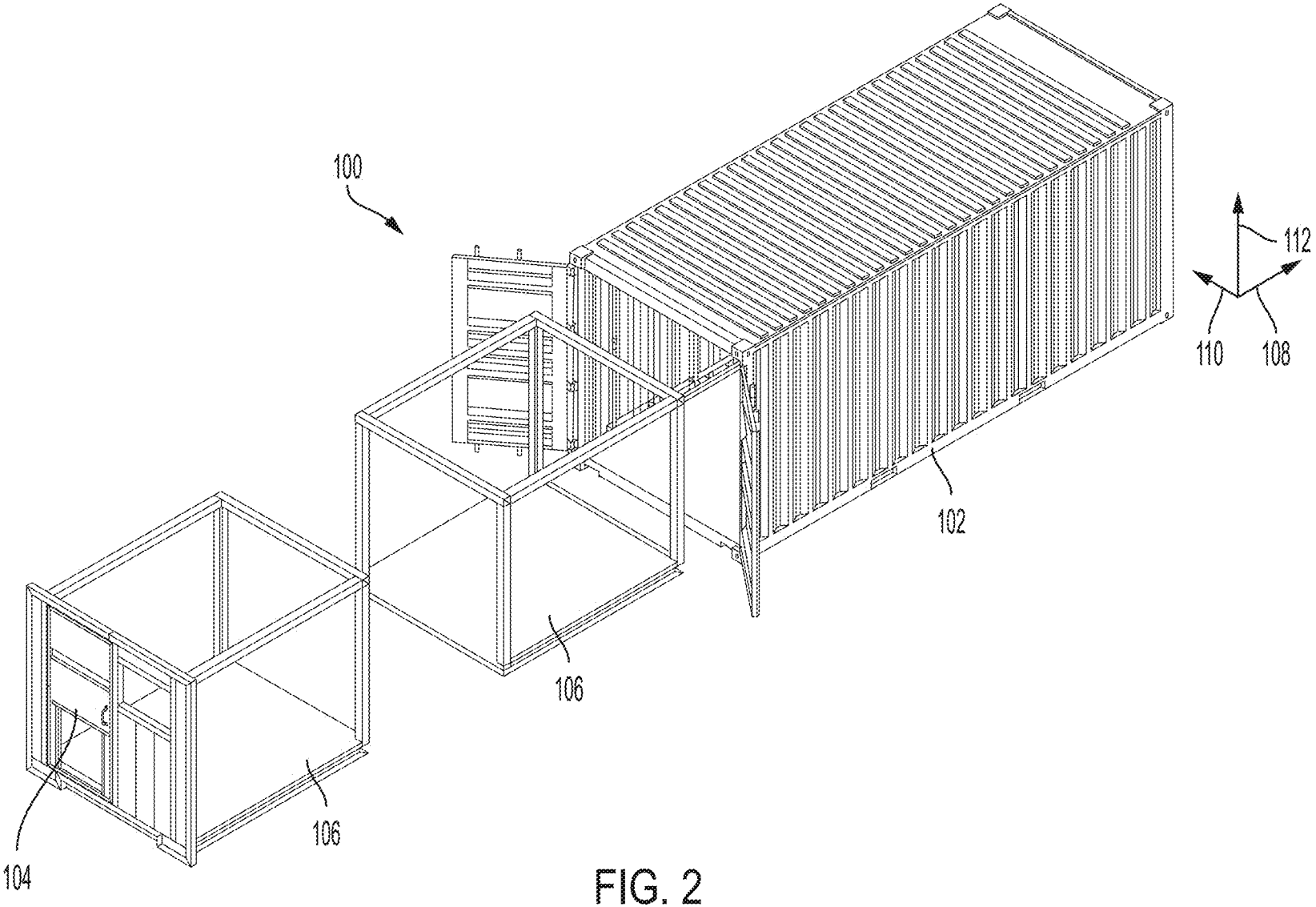
FIG. 2 is perspective view of a modular facility formation system and cargo securement system showing two modules prior to installation within a container according to various embodiments described below.

FIG. 2 shows the modular facility formation system 100 prior to insertion of the modules 106. In this example, two modules 106 fit within the shipping container 102. The module 106 that is adjacent to the doors of the shipping container 102 is configured with a removable wall 104 having a door for ingress and egress of the modular facility formation system 100. It should be noted that the modules 106 shown here and throughout the various drawings are shown as a basic empty structure, without any of the incorporated equipment or pre-defined arrangement or configuration of components or structure that may be incorporated according to the desired function of the module 106.

Each module 106 provides the framework for a room or enclosure that will be suitable for a particular application. Each module 106 may be configured for the particular application for which it will be used at the destination location. For example, a module 106 that will be used to store and/or maintain batteries at the destination may be pre-configured with the appropriate storage bins and/or shelving with the corresponding electrical connections and wiring. A module 106 that is to be used as a metal shop may be pre-configured with the appropriate shop equipment fixedly or removably secured to the flooring or framework of the module. It should be appreciated that the modules 106 may be configured in virtually endless configurations according to the desired use and/or for efficient shipping, such configurations to include, but not be limited to, petroleum oil and lubricant storage and maintenance, glycol recycling and/or generation, milling and machining, fabrication and welding shop, battery charging, small arms repair, hydraulic fabrication and repair, mobile water treatment, mobile solar power facility, and general maintenance facility.

As described in further detail below, the modular facility formation system 100 provides bracing that is configured to guide the module 106 into the shipping container 102 along a longitudinal axis 108 while preventing movement of the module along a horizontal axis 110 and along a vertical axis 112. After installing the bracing according to the methods described herein, the modules 106 may be maneuvered with a forklift of other vehicle and slid into the shipping container along the longitudinal axis 108 of the container. The bracing and the removable wall prevent movement once the modules 106 are in position inside the container.

Figure 3B:
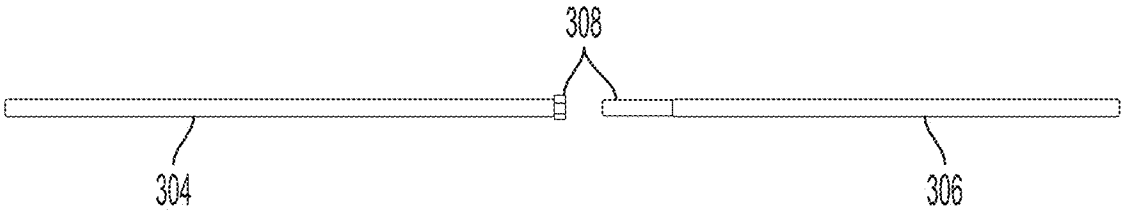
FIGS. 3A and 3B show perspective and exploded views, respectively of an assembled and unassembled bracing rod according to various embodiments described below.
Figure 3A:
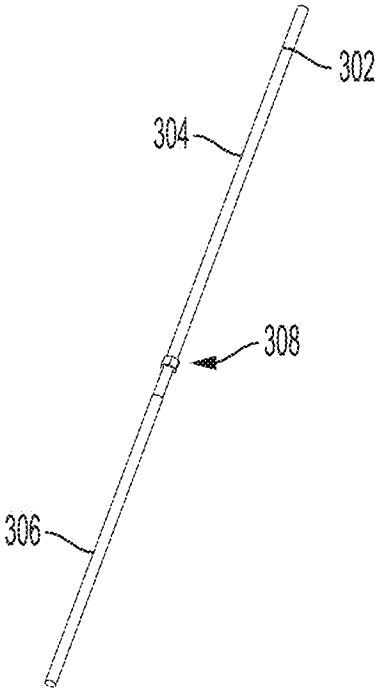

FIGS. 3A and 3B show a bracing rod 302 in assembled and unassembled configurations, respectively. The bracing rods 302 are used to secure the braces within the shipping container 102, which will engage the modules 106 to secure the modules 106 in place within the shipping container 102. According to various embodiments, the bracing rods 302 are two-piece rods. A first rod portion 304 is coupled to a second rod portion 306 via an adjustment mechanism 308. According to one embodiment, the adjustment mechanism 308 includes a nut secured to one end of the first rod portion 304 or the second rod portion 306, and a corresponding threaded insert at an end of the other rod portion. When the two rod portions are threaded together to create the bracing rod 302, rotation of one rod piece in a first direction lengthens the bracing rod 302 to apply a compressive force to the upper and lower braces that abut the ceiling and the floor, respectively, of the shipping container 102. Doing so provides a pressure fit of the braces to secure the braces against the opposing container surfaces, which functions to guide and secure the modules 106 in the container. Rotation in an opposite direction shortens the bracing rod 302 to release the pressure applied to the upper and lower braces for removal from the shipping container 102. It should be understood that the bracing rod 302 is not limited to the threaded configuration shown and described here. Rather, any bracing rod that is extendable via any mechanism to apply a force against the upper and lower braces may be used without departing from the scope of this disclosure. While the various figures include dimensions for various components, it should be understood that these dimensions are meant to provide an illustrative example and are not intended to be limiting.

According to various embodiments, lower braces are used within the shipping container 102 to guide and secure the modules 106. The lower braces are two-part braces that includes a front lower brace and a rear lower brace. It should be appreciated that the front and rear lower braces may alternatively be manufactured as a single brace that extends from front to rear of the shipping container 102 rather than being a two-part component as described herein.

Figure 4B:
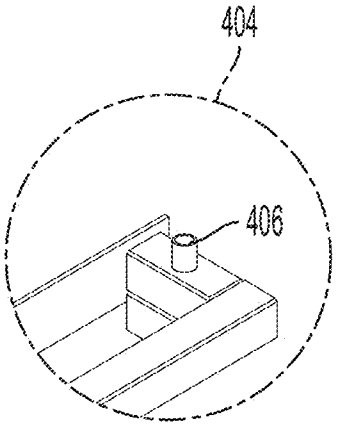
FIGS. 4A and 4B are perspective and enlarged views of a front lower brace and corresponding coupling mechanism according to various embodiments described below.
Figure 4A:
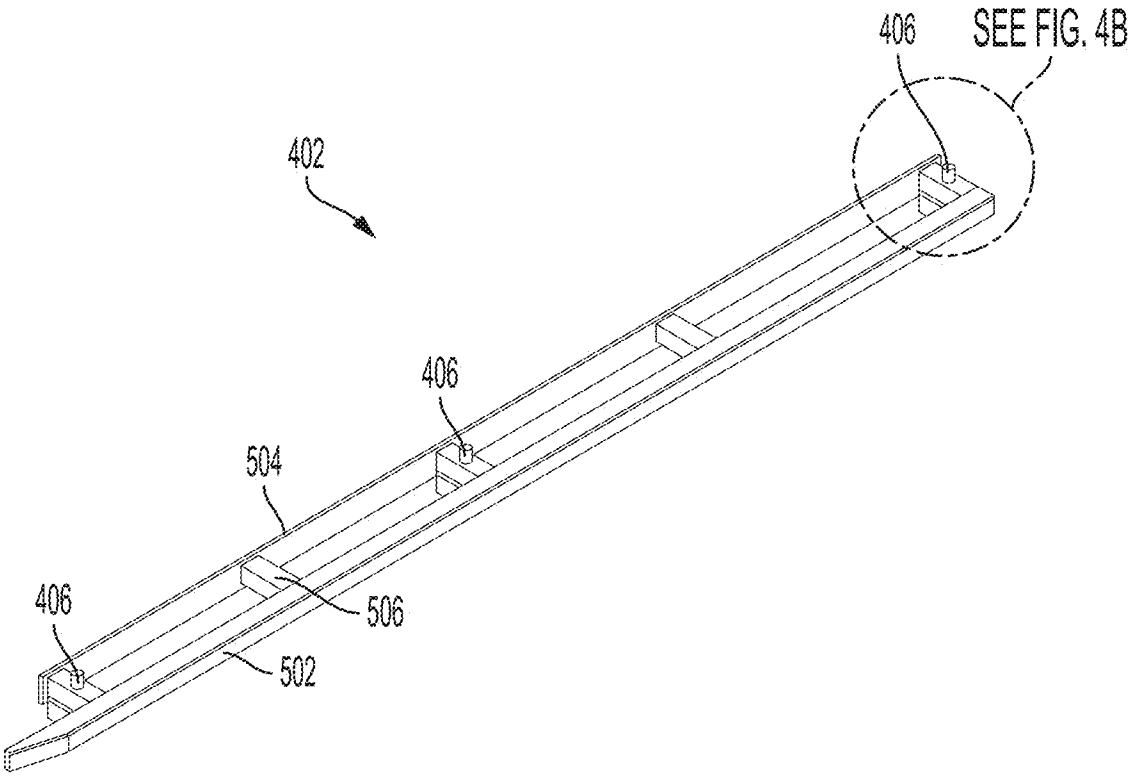
Figure 5A:
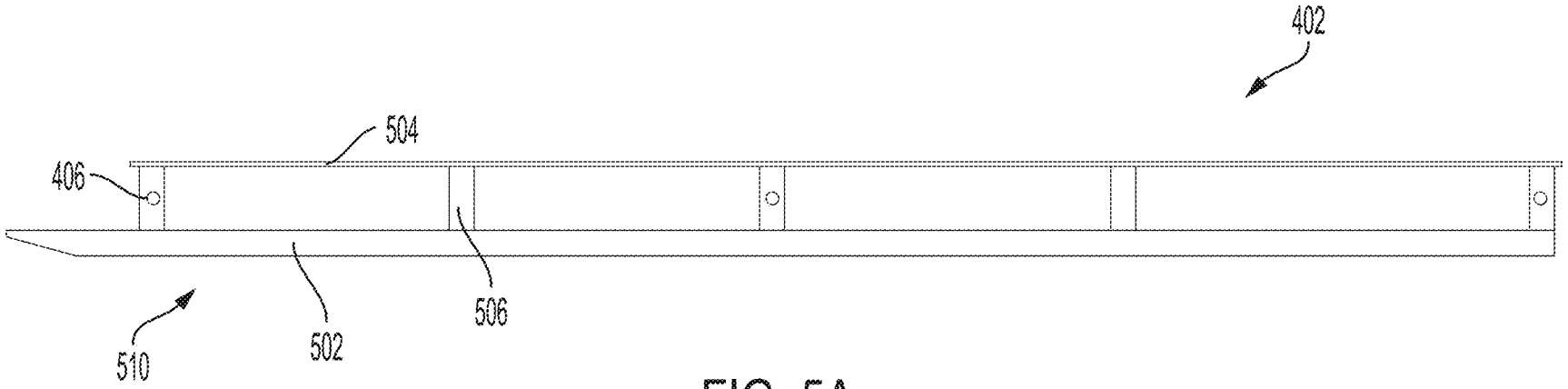
FIGS. 5A and 5B show top and side views, respectively, of a front lower brace according to various embodiments described below.
Figure 5B:
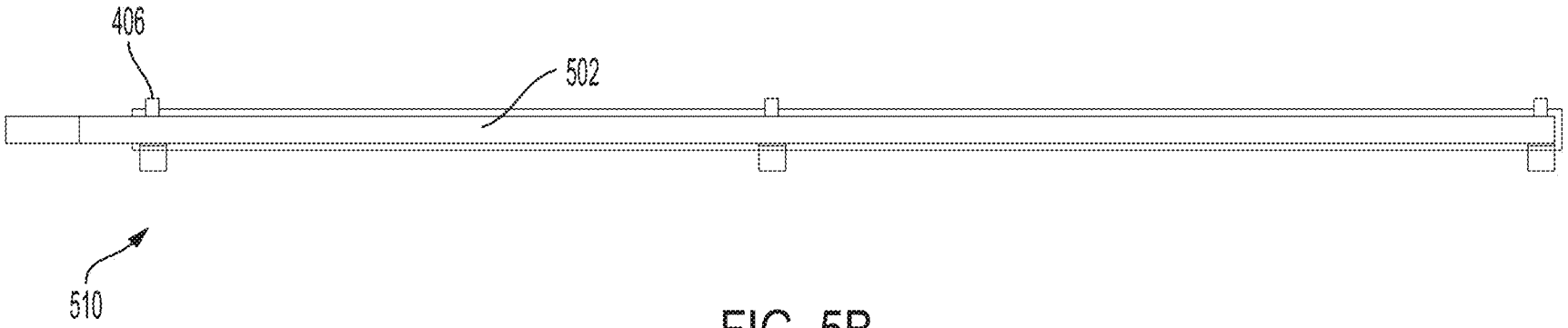
Figure 6B:
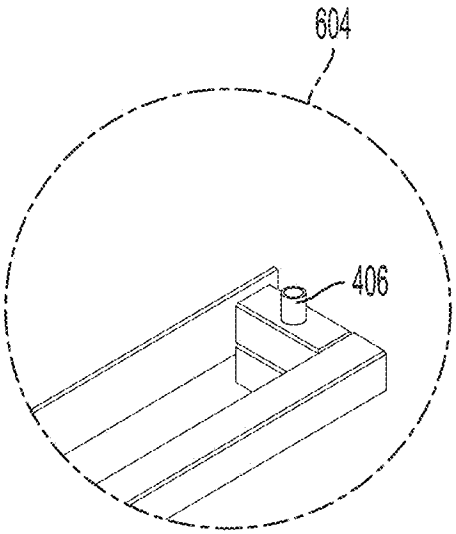
FIGS. 6A and 6B are perspective and enlarged views of a rear lower brace and corresponding coupling mechanism according to various embodiments described below.
Figure 6A:
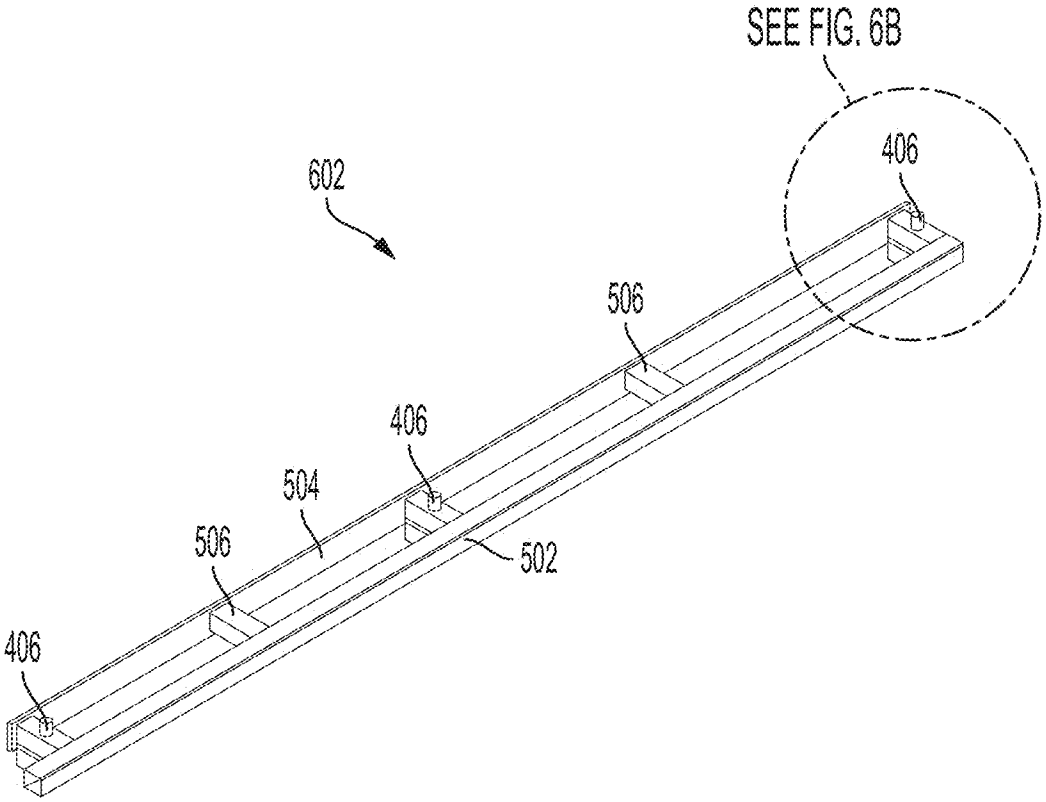
Figure 7A:
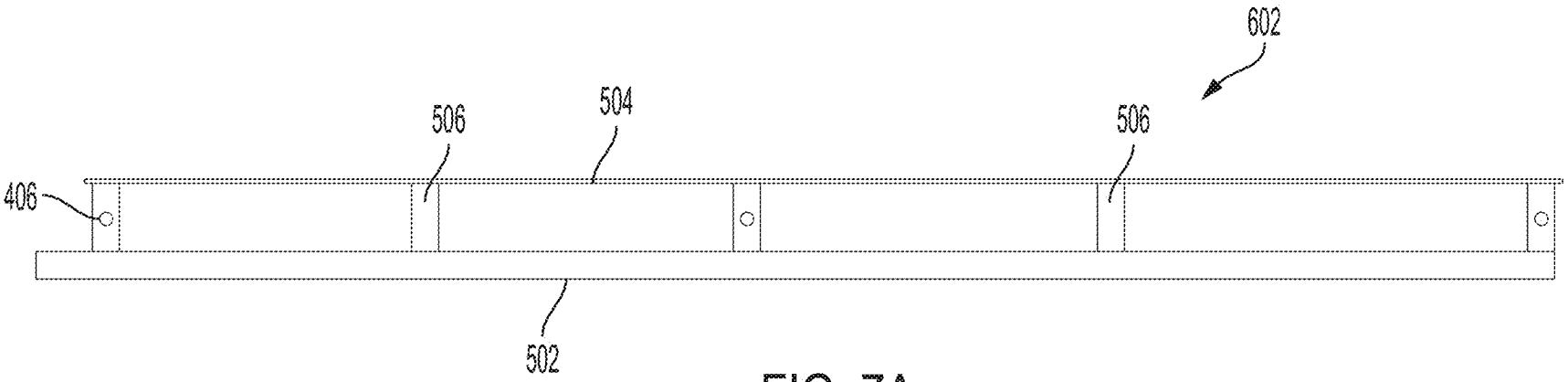
FIGS. 7A and 7B show top and side views, respectively, of a rear lower brace according to various embodiments described below.
Figure 7B:
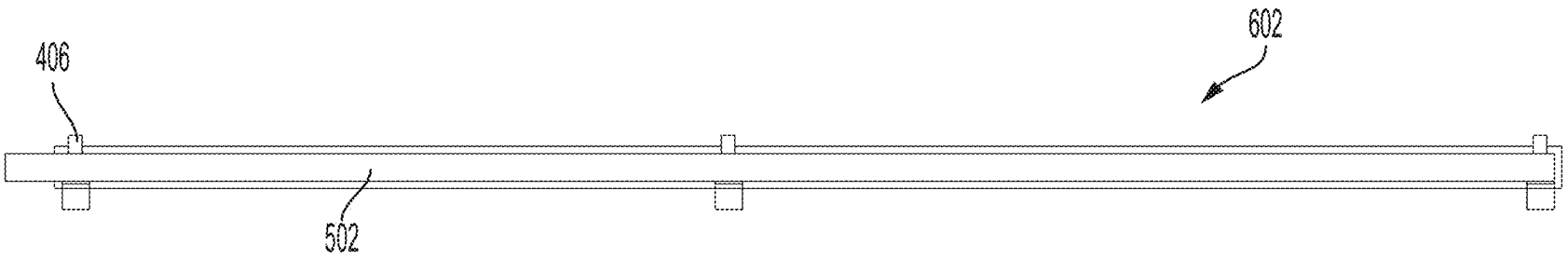
Figure 8B:
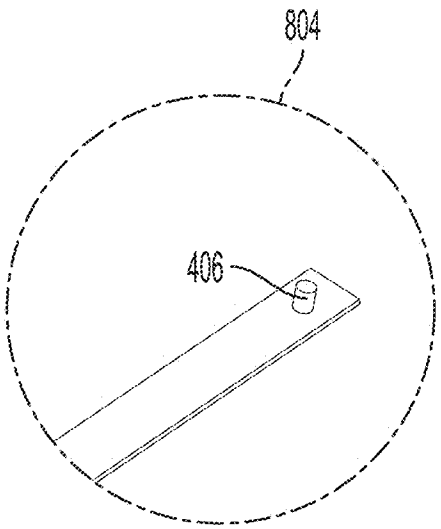
FIGS. 8A and 8B are perspective and enlarged views of an upper brace and corresponding coupling mechanism according to various embodiments described below.
Figure 8A:
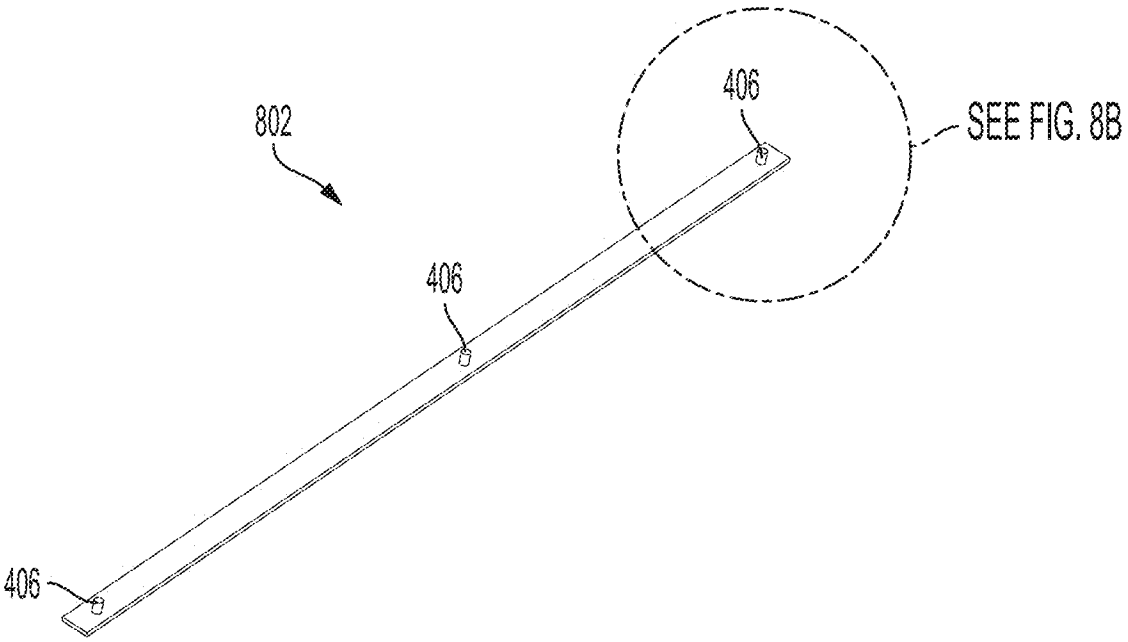
Figure 9A:
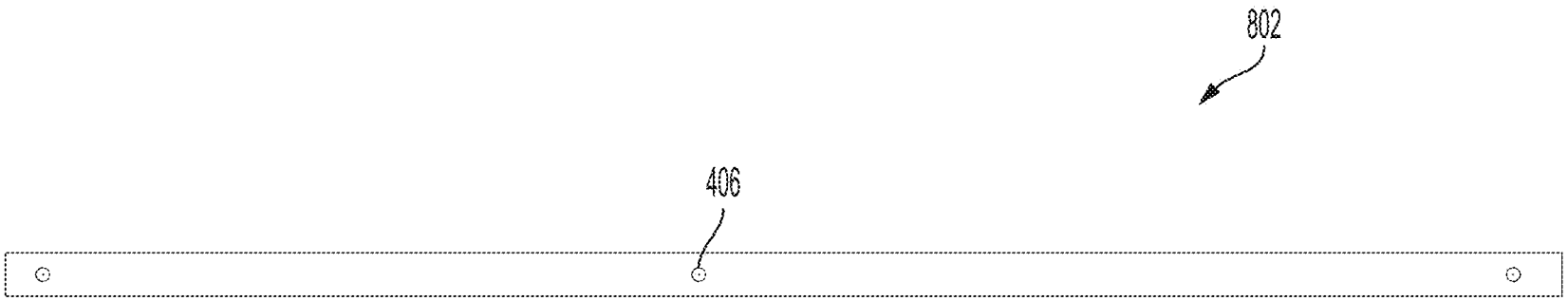
FIGS. 9A and 9B show top and side views, respectively, of an upper brace according to various embodiments described below.
Figure 9B:
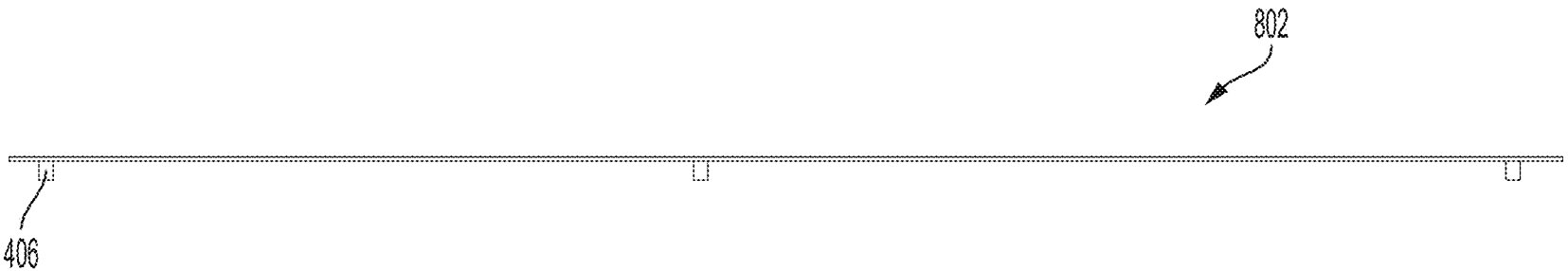
Figure 10B:
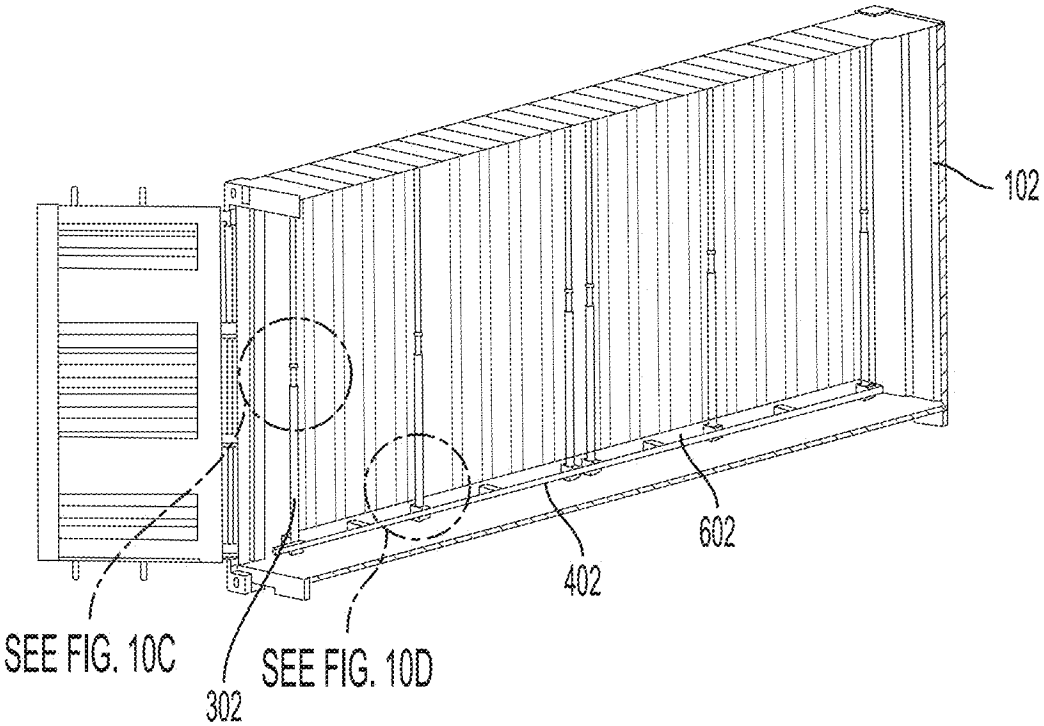
FIGS. 10A and 10B are front and cross-sectional view of a modular facility formation system showing bracing rods engaging a front lower brace and a rear lower brace according to various embodiments described below.

FIGS. 4A, 5A, and 5B show perspective, top, and side views, respectively, of a front lower brace 402. Similarly, FIGS. 6A, 7A, and 7B show perspective, top, and side views, respectively, of a rear lower brace 602. The rear lower braces 602 are positioned on opposite sides of the floor of the shipping container 102 at the rear where the side wall of the container meets the floor proximate to the back wall of the container. The front lower braces 402 abut or are adjacent to the rear lower braces 602, but positioned at the front of the shipping container where the side walls meet the floor. FIG. 10B shows a clear view of this positioning.

The front and rear lower braces are each configured with a module engagement mechanism configured to engage a module 106 and guide the module 106 into the shipping container 102 along the longitudinal axis 108 while preventing movement of the module along the horizontal axis 110 and along the vertical axis 112. According to various embodiments, the module engagement mechanism includes a module engagement rail 502 that is sized for sliding within a rail guide of the module 106 (shown and described below with respect to FIG. 13) to guide and secure the module 106 in position within the shipping container 102. The module engagement rails 502 of the front lower braces have a tapered portion 510 to assist with insertion into corresponding rail guide of the module 106 during installation of the module 106 into the shipping container 102. Each front and rear lower brace is also configured with a wall engagement rail 504 that abuts against the side wall of the shipping container 102. The wall engagement rails 504 and the module engagement rails 502 are spaced apart using spacers 506.

Coupling mechanisms 406 may be positioned on any number of spacers 506 or any other desired component of the front and rear lower braces. The coupling mechanisms 406 each engage an end of a bracing rod 302 to secure the bracing rod 302 to the brace. According to one embodiment, the coupling mechanisms 406 each include a tube, rod, or other projection that is inserted into an end of the bracing rod 302. According to other embodiments, the coupling mechanisms 406 each include a recess, aperture, or other shaped element of the brace into which a bracing rod 302 is inserted. Views 404 and 604 of FIGS. 4B and 6B, respectively, show close up views of the end portions of the respective braces to illustrate one embodiment of the coupling mechanisms 406 in which the coupling mechanisms 406 include upward projections configured to engage a bracing rod 302.

FIGS. 8A-9B show corresponding views of an upper brace 802. According to various embodiments, the upper braces 802 are configured as flat bars or structural members with coupling mechanisms 406 projecting downward at locations corresponding to the coupling mechanisms 406 on the front lower braces 402 and rear lower braces 602. View 804 of FIG. 8B shows a close up view of an end portion of an upper brace 802 with a coupling mechanism 406 embodied as a projection that will face downward when the upper brace 802 is installed against the ceiling of the shipping container 102. The coupling mechanisms 406 are configured to engage an end of the bracing rods 302 as described above with respect to the coupling mechanism 406 of the lower braces. According to one embodiment, four upper braces 802 may be utilized within a shipping container 102, including one positioned against the ceiling of the container on the left rear side, one positioned against the ceiling of the container on the right rear side, one positioned against the ceiling of the container on the left front side, and one positioned against the ceiling of the container on the right front side. According to another embodiment, two upper braces 802 may be used, including one positioned against the ceiling of the container on the left side and extending substantially along the length of the container, and one positioned against the ceiling of the container on the right side and extending substantially along the length of the container. Any number of upper braces 802 may be utilized without departing from the scope of this disclosure.

Figure 10A:
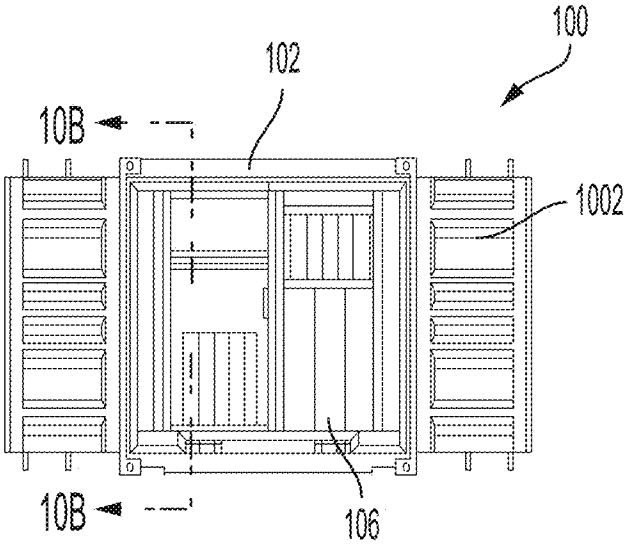
Figure 11A:
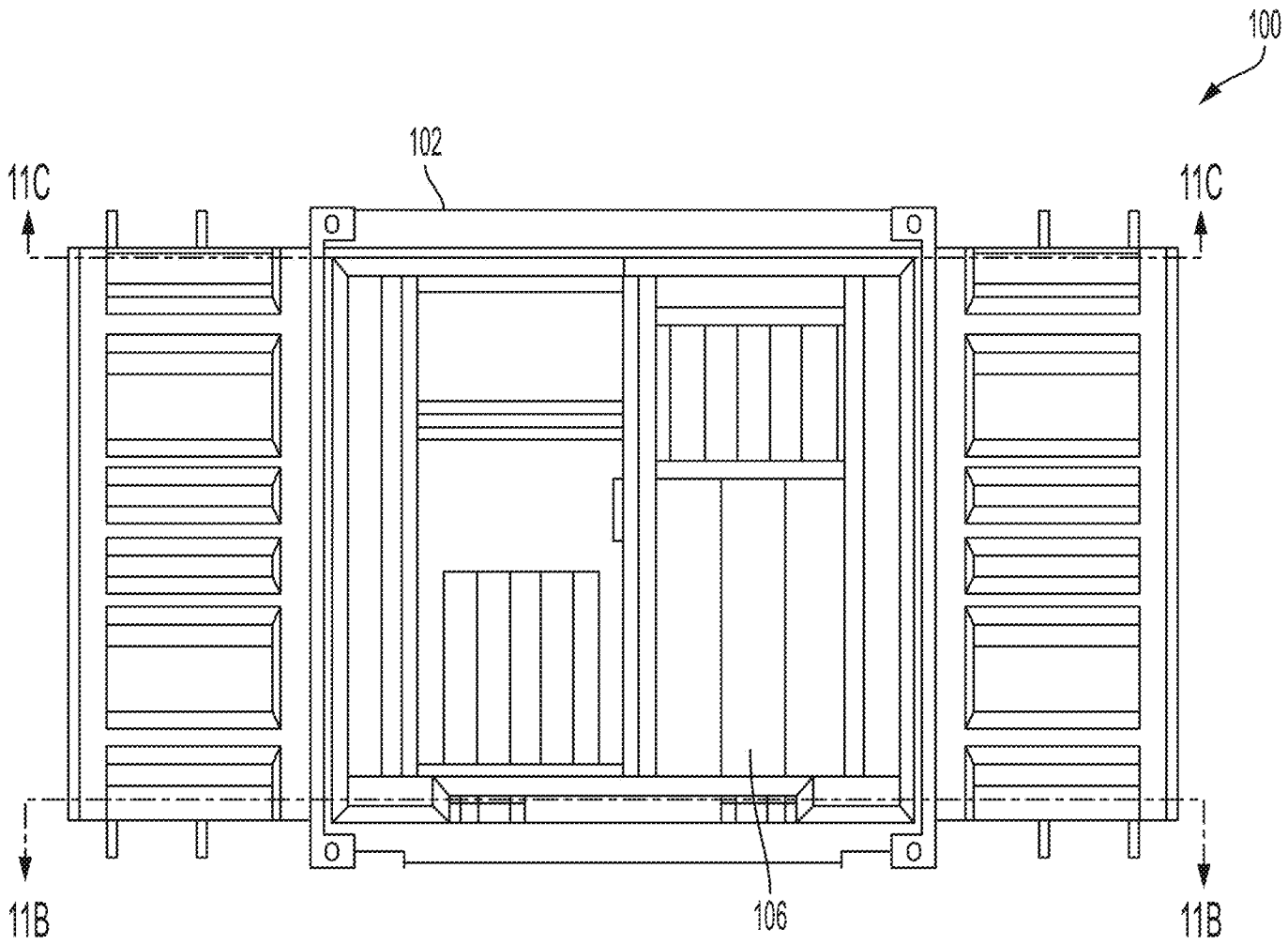
FIG. 11A is front view of a modular facility formation system showing a module within a container with the container doors open according to various embodiments described below.

FIG. 10A shows a front view of a modular facility formation system 100 with modules 106 installed within a shipping container 102. FIG. 11A is a larger view of the modular facility formation system 100. In this example, the doors 1002 of the shipping container 102 are open and the removable wall 104 installed on the first module 106 is accessible. The modules 106 are secured within the shipping container 102 using lower and upper braces, which are pressure fit into the container using bracing rods 302. The resulting facility uses the shipping container 102 as the outer walls of the interior rooms created by the modules 106. The removable door 104 provides access to the facility. The doors 1002 of the shipping container 102 may be closed and secured for transit.

Figure 10D:
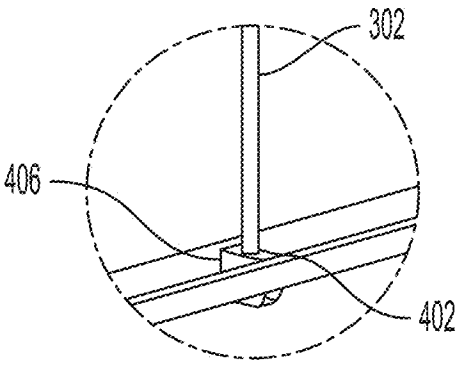
FIG. 10D is an enlarged view of a bracing rod engaging a coupling mechanism of a front lower brace of FIG. 10B according to various embodiments described below.
Figure 10C:
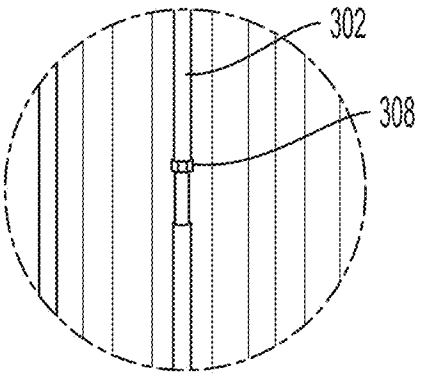
FIG. 10C is an enlarged view of an adjustment mechanism of FIG. 10B according to various embodiments described below.

FIG. 10B shows a cross-sectional view of the modular facility formation system 100 with the modules 106 and removeable wall 104 removed for clarity purposes. This view shows a front lower brace 402 and a rear lower brace 602 positioned on the floor of the shipping container 102 abutting the side wall. Bracing rods 302 provide a force pushing downward against the lower braces and upwards against the upper braces 802 (not shown in FIG. 10B) to secure them in place against the floor and ceiling, respectively, of the shipping container 102. FIG. 10C shows an enlarged view of an adjustment mechanism 308 of a bracing rod 302, and FIG. 10D is an enlarged view of a bracing rod 302 engaging a coupling mechanism 406 of a front lower brace 402. A top or bottom portion of the bracing rod 302 and corresponding adjustment mechanism 308 may be rotated in opposite directions to lengthen the bracing rod 302 to provide the compressive force against the upper and lower braces to secure the braces in place, or to shorten the bracing rod 302 to remove the compressive force and allow for removal of the upper and lower braces.

Figure 11C:
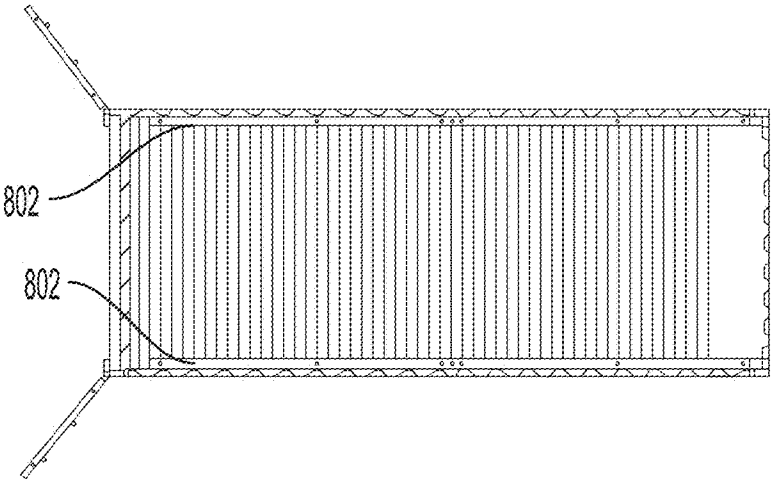
FIGS. 11B and 11C are cross-sectional views of the bottom and top, respectively, of a modular facility formation system showing positioning of braces within a container according to various embodiments described below.
Figure 11B:
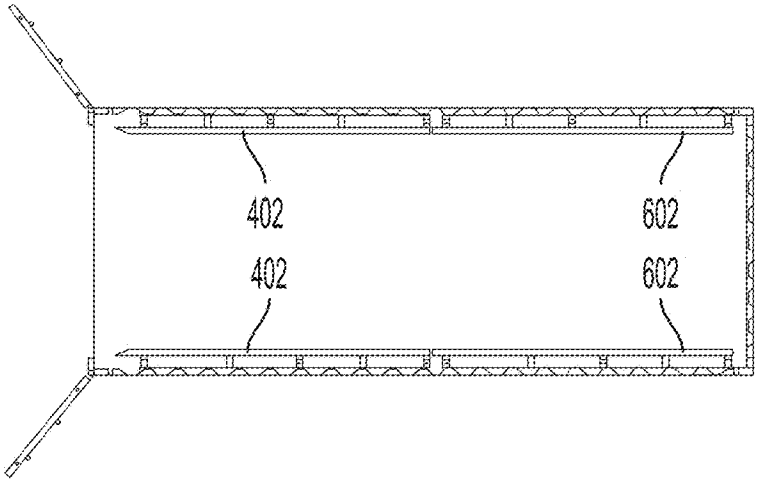

As stated above, FIG. 11A is front view of the modular facility formation system 100 with the doors 1002 of the shipping container 102 open and the removable wall 104 installed on the first module 106 accessible. FIG. 11B shows a cross-sectional view of the modular facility formation system 100 showing the front lower braces 402 and rear lower braces 602 positioned against the floor of the shipping container 102. Similarly, FIG. 11C shows a cross-sectional view of the modular facility formation system 100 showing the upper braces 802 positioned against the ceiling of the shipping container 102.

Figure 12:
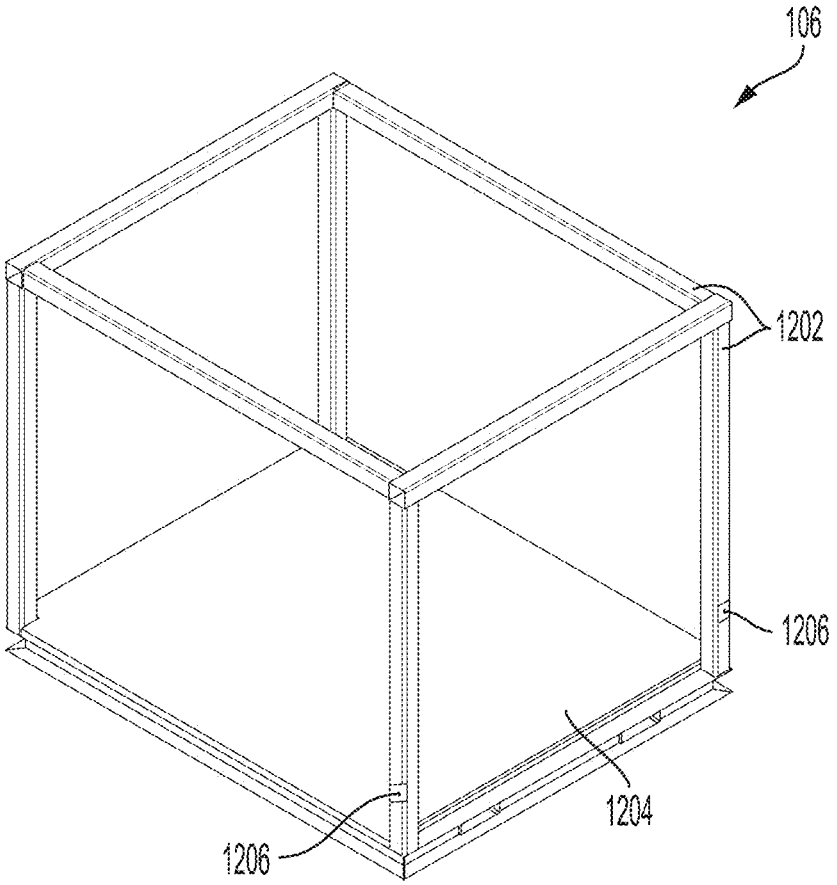
FIG. 12 is perspective view of a module according to various embodiments described below.
Figure 13B:
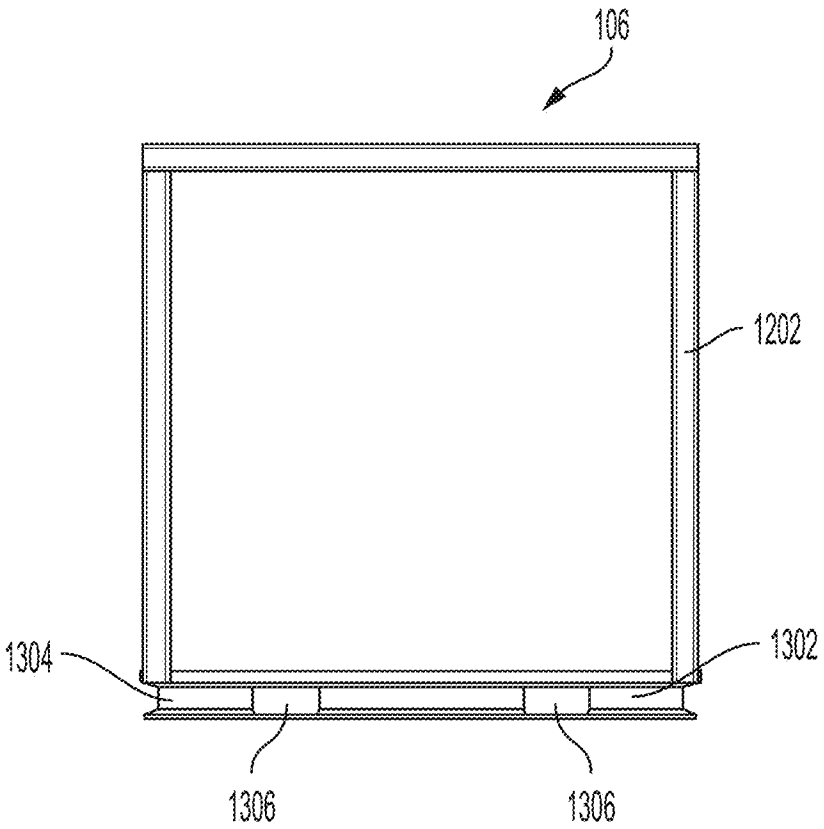
FIGS. 13A and 13B show side and front views, respectively, of a module according to various embodiments described below.
Figure 13A:
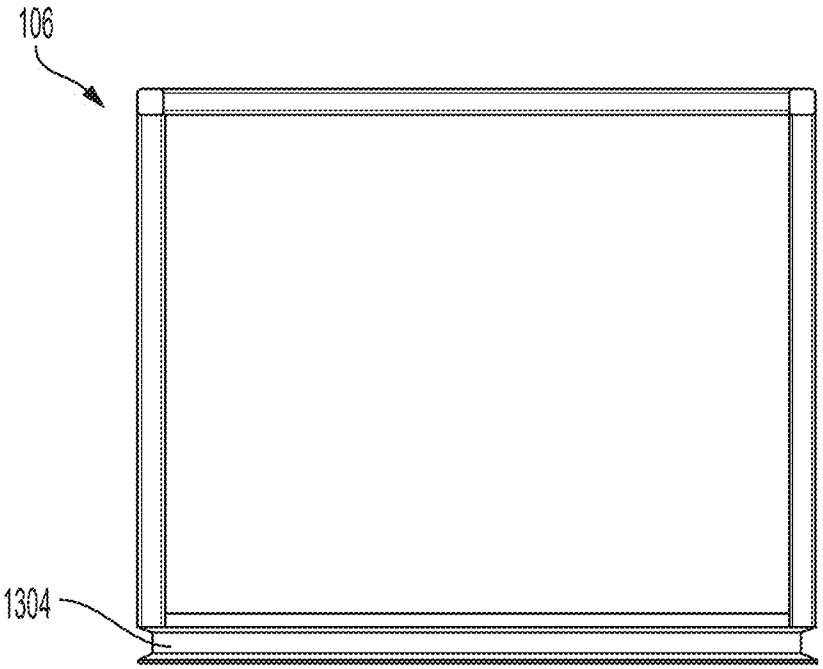

Turning now to FIGS. 12, 13A, and 13B, various aspects of the modules 106 will be discussed. FIG. 12 shows a perspective view of a module 106. FIGS. 13A and 13B show side and front views, respectively, of the module 106. According to one embodiment, the module 106 includes a framework 1202 that includes structural members coupled to one another to form a box or cube that is sized according to the internal dimensions of a shipping container 102. In the example shown, the framework 1202 may be made from 4-inch square tubing. A floor or treadplate 1204 is provided at the bottom of the module 106 for walking, as well as for placing, and/or securing equipment and components within the module 106. The treadplate 1204 may be manufactured from any material suitable for supporting the weight of the equipment, components, supplies, furniture, and/or personnel ("module contents" or "cargo") for which the module 106 is designed. The treadplate 1204 and/or other module structural elements may include any desired number and configuration of mounting locations for securing module contents in place. For example, according to one embodiment, the treadplate 1204 may include tie downs at strategic locations. According to another embodiment, the treadplate 1204 may include threaded apertures for receiving bolts for securing equipment in place.

The module 106 may include any type and number of connectors 1206. For the purposes of clarity, connectors 1206 are only shown as boxes in two places in FIG. 12. It should be understood that connectors 1206 may be located in any applicable or desired location according to the function of the connector, the function of the module 106, and/or the function of the facility. A connector 1206 may be a mechanical connector to mechanically secure the module 106 to an adjacent module 106, component, or piece of equipment. A connector 1206 may be an electrical or data connector configured to electrically or communicatively couple the module 106 to an adjacent module 106, component, piece of equipment, external power source, and/or data or communication network.

FIGS. 13A and 13B show side and front views, respectively, of the module 106. The module 106 includes a floor system 1302 onto which the treadplate 1204 is positioned. The floor system 1302 provides a structurally sound base for supporting the module contents within the module 106, provides a mechanism for moving the module 106 via forklift apertures 1306, and provides a mechanism for guiding and securing the module 106 within the shipping container 102 via rail guides 1304.

Figure 14B:
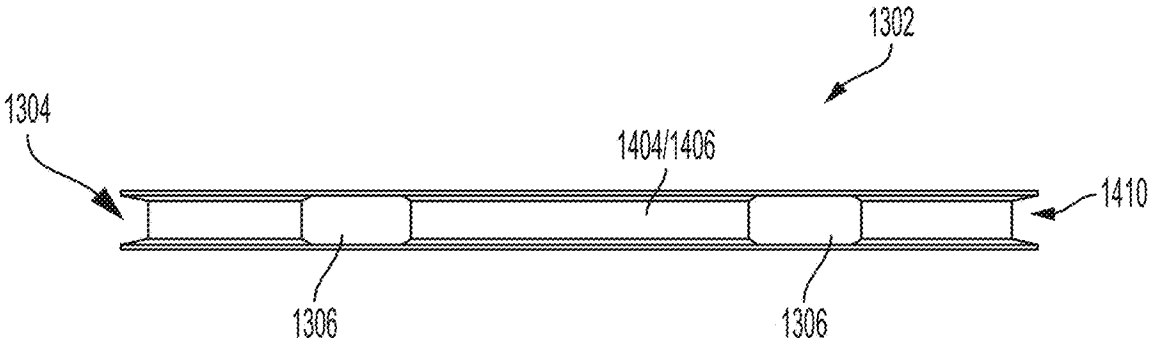
FIGS. 14A-14C show top, front, and side views, respectively, of a floor system of a module according to various embodiments described below.
Figure 14C:
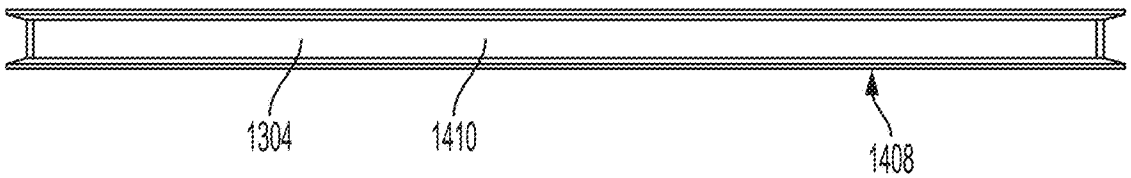
Figure 14A:
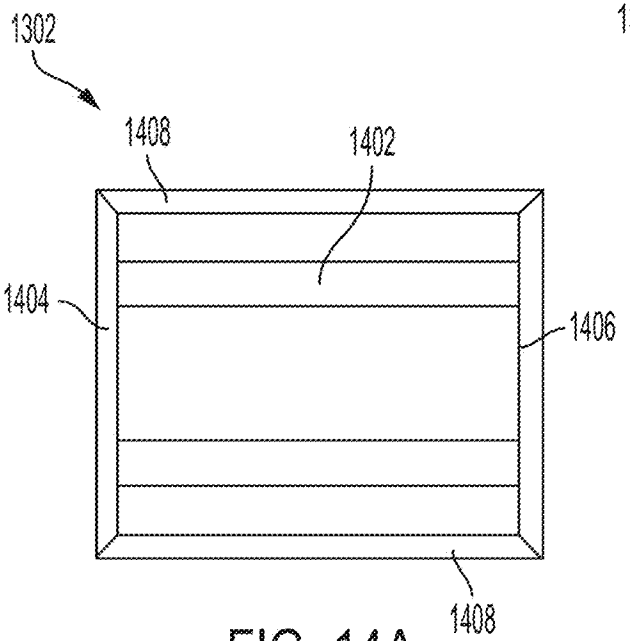

FIGS. 14A-14C and 15 show various views of the floor system 1302 and associated features according to one embodiment. The floor system 1302 includes, among other components described below, a front base member 1404, a rear base member 1406, and opposing side base members 1408. The front, rear, and side base members define a base perimeter. According to one embodiment, the floor system 1302 base perimeter is formed with I-beams, or more specifically wide-flanged or W-beams. The characteristics of these beams provides sufficient structural support, while also providing the externally-facing configuration that creates the rail guides 1304 that the front lower braces 402 and the rear lower braces 602 engage to guide and secure the module 106 within the shipping container 102. Specifically, as seen in FIGS. 14B and 14C, the flanges of an I-beam or W-beam, coupled with the web of the beam, create a substantially "C"-shaped channel, or guidance mechanism 1410, that is sized to receive the module engagement rails 502 of the front and rear lower braces 402 and 602 to create rail guides 1304. The rail guides 1304 allow for movement of the module 106 along the longitudinal axis 108 of the shipping container 102. The snug fit of the module 102, or close tolerances between the lower braces and the guidance mechanism 1410, and specifically the engagement of the module engagement rails 502 with the web of the beam or vertical portion of the rail guides 1304, prevents movement of the module 106 along the horizontal axis 110 of the shipping container. The top and bottom flanges of the rail guides 1304 prevent movement of the module 106 along the vertical axis 112 of the shipping container 102. It should be appreciated that the floor system 1302 and/or any portion of the module 106 may include one or more D-rings or other mechanism for attachment of a tie-down, cable, or chain to assist in maneuvering the module 106 into our out of a container 102.

The floor system 1302 includes, among other components described below, two tubes or conduits 1402 with substantially rectangular cross-sections to provide the forklift apertures 1306 for moving the module 106 to and from a shipping container 102. While the term "forklift apertures" is used herein, it should be appreciated that the conduits 1402 and corresponding apertures 1306 may have any suitable cross-sectional shape configured to receive tines of a forklift or other corresponding portions of any type of transfer vehicle for engaging with the module 106 for lifting or relocation. The forklift apertures 1306 are accessible through the front base member 1404 and the rear base member 1406 via apertures cut or otherwise created in the beams used for the front and rear base members. Alternatively, the front and rear base members 1401 and 1406, respectively, may be formed from three separate beam sections welded or coupled together to allow for the conduits 1402 that create the forklift apertures 1306.

Figure 15:
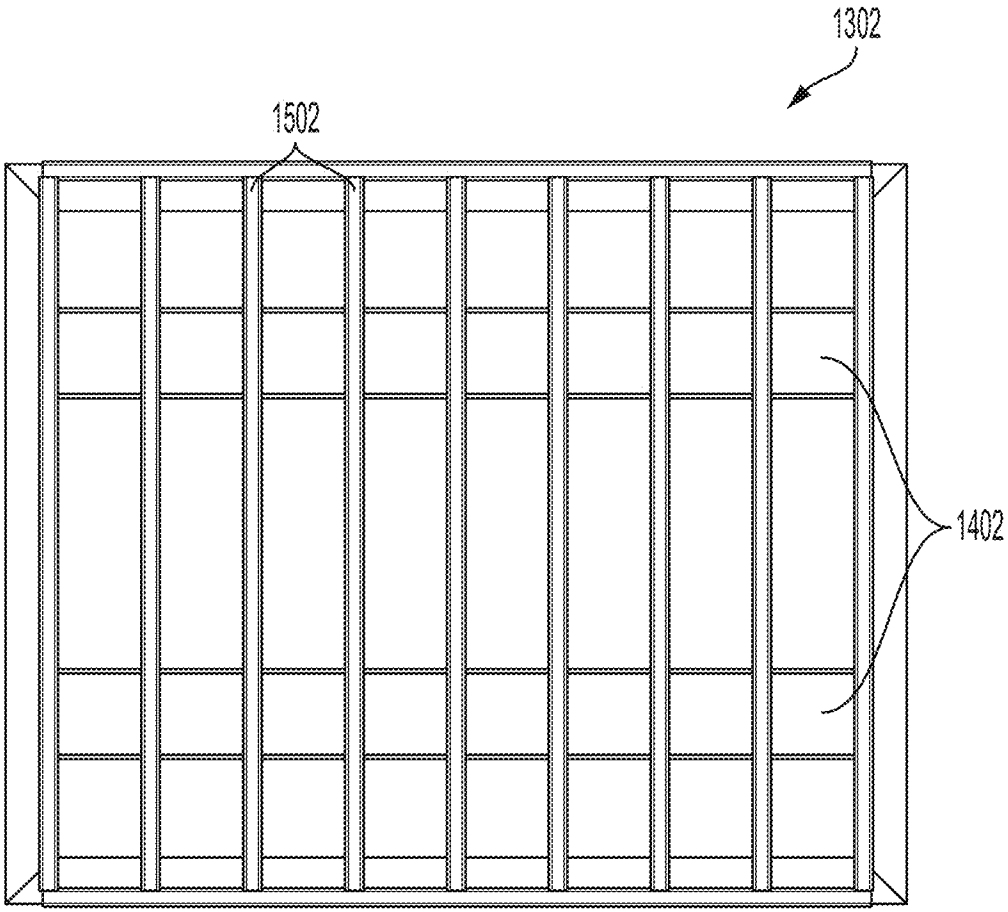
FIG. 15 is top view of a floor system with treadplate support members installed according to various embodiments described below.

As seen in FIG. 15, treadplate support members 1502 (e.g., tubing manufactured from steel, other metal, polymer, and/or composite material) are arranged in parallel rows across the floor system 1302, normal to the direction of the conduits 1402. The treadplate support members 1502 provide support for the treadplate 1204. The number and orientation of the treadplate support members are not intended to limit the scope of this disclosure. Rather, any components or structural members may be used to support the treadplate 1204. For clarity purposes, the treadplate 1204 is not shown in FIG. 15.

Figure 16A:
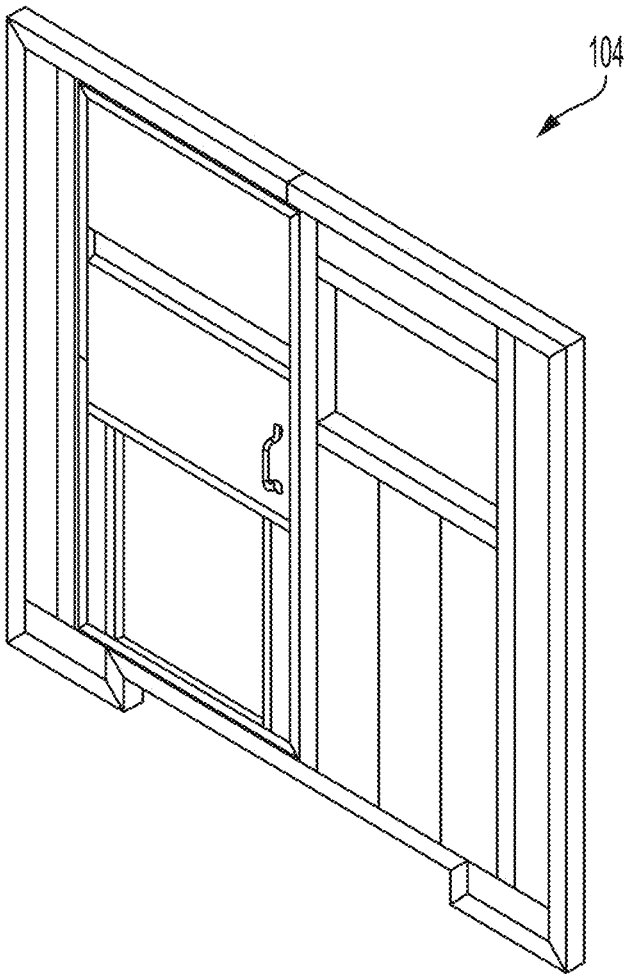
FIGS. 16A-16E show perspective, front, side, rear perspective, and exploded views of a removable wall according to various embodiments described below.
Figure 16C:
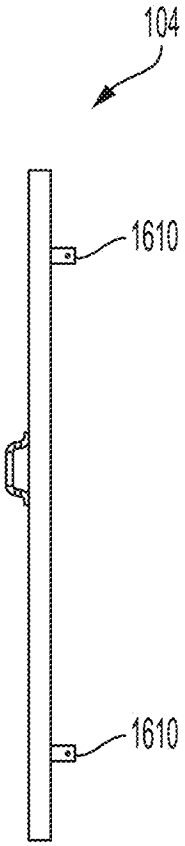
Figure 16B:
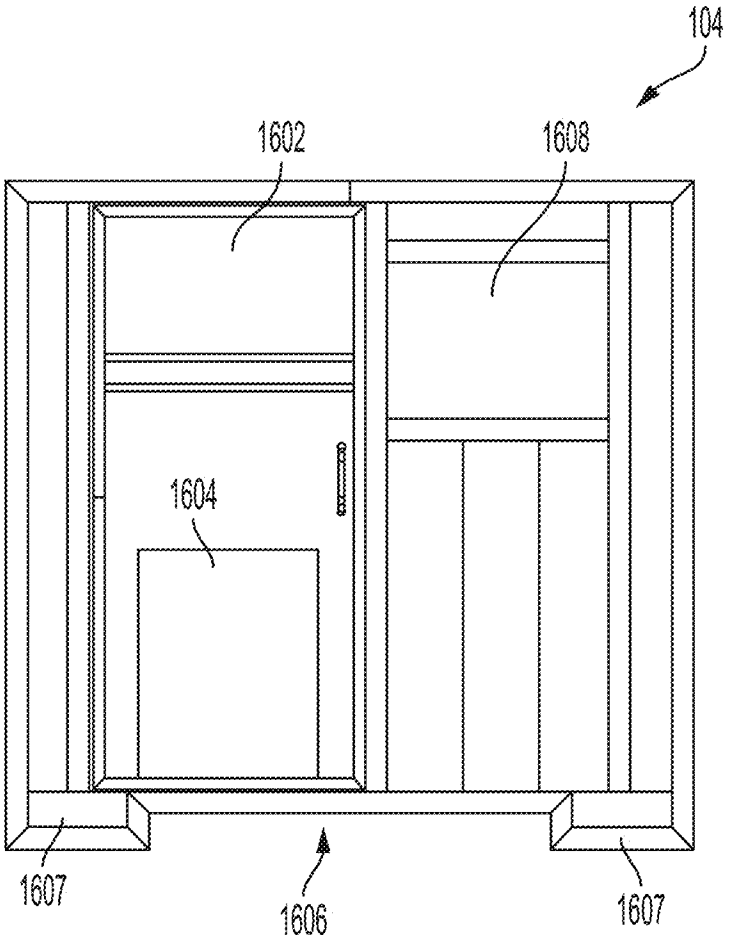
Figure 16D:
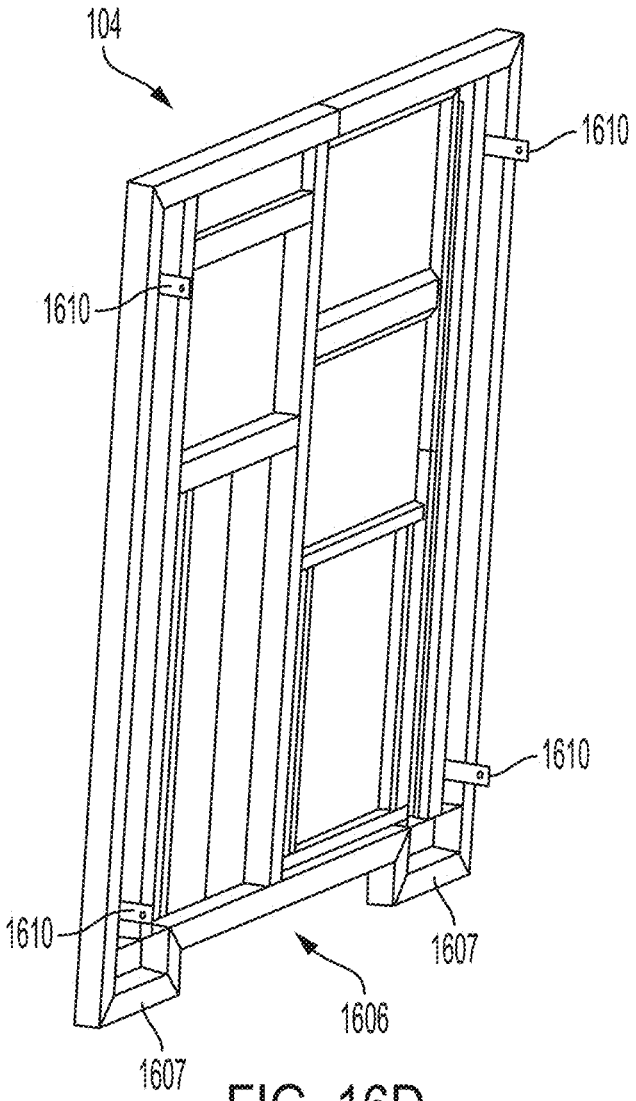

FIGS. 16A-16E show perspective, front, side, rear perspective, and exploded views of a removable wall to illustrate components and aspects of the removable wall 104 according to various embodiments described herein. It can be seen that the removable wall 104 may include any number and type of apertures and features used for ingress, egress, and for accommodating accessories for the module 106. For example, FIG. 16B shows a door 1602 and an access space 1604 within the door for a specialty egress door. According to this example, an environmental control unit (ECU) aperture 1608 is configured to accommodate an air conditioning and/or heating unit to control a temperature and environmental conditions within the module 106.

Figure 16E:
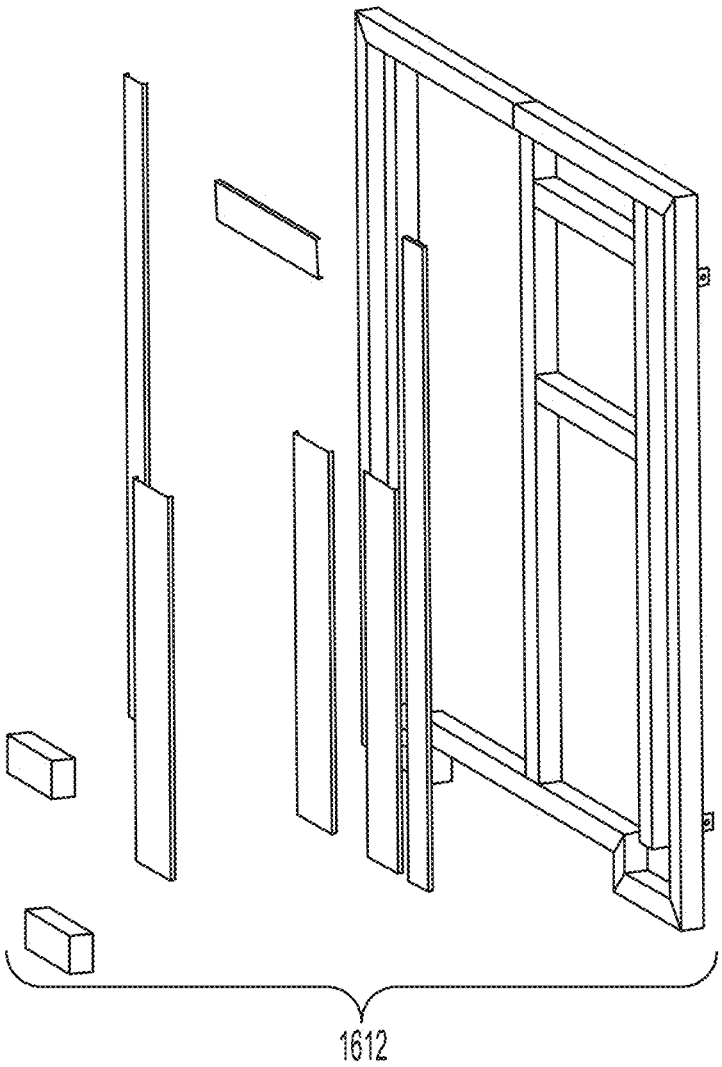

According to one embodiment, the removable wall 104 is sized to substantially fill the inside cross-sectional dimensions of the shipping container 102. Said another way, the distance between the outer edges of the sides of the removable wall 104 are substantially equal to or slightly shorter than the distance between the inside walls of the shipping container 102. In doing so, the stops 1607 of the removable wall 104 cover the fronts of the front lower braces 402, preventing the module 106 from sliding forward and out of the shipping container 102. This configuration effectively locks the module 106 in place within the shipping container 102 while allowing the doors of the shipping container 102 to be opened and closed. The forklift access 1606 provides a gap or raised portion in the bottom of the removable wall 104 to provide access to the forklift apertures 1306 of the module 106 to which the removable wall 104 is attached. Locking tabs 1610 may be used to mechanically couple the removable wall 104 to the module 106. Locking tabs 1610 are described in further detail below with respect to FIGS. 17A-17C. Any gaps within the framework of the removable wall 104 may be filled with sheet metal or other suitable material to prevent access to the module 106, as is shown in FIG. 16E, which shows components 1612 of the removable wall 104 in an exploded view of the removable wall 104.

Figure 17B:
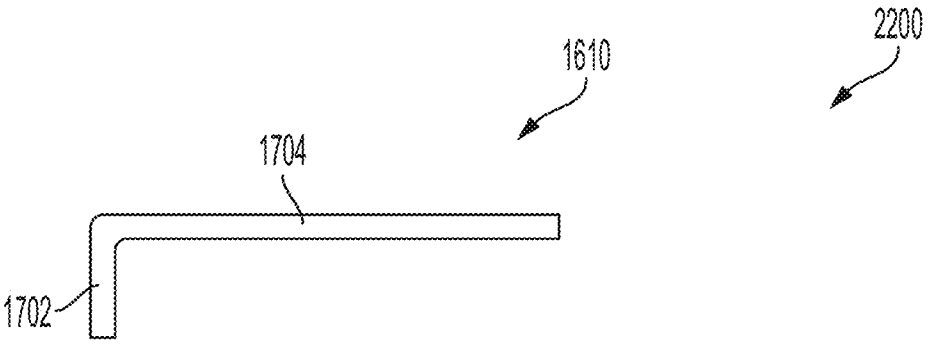
FIGS. 17A-17C show perspective, top, and front views of a locking tab according to various embodiments described below.
Figure 17C:
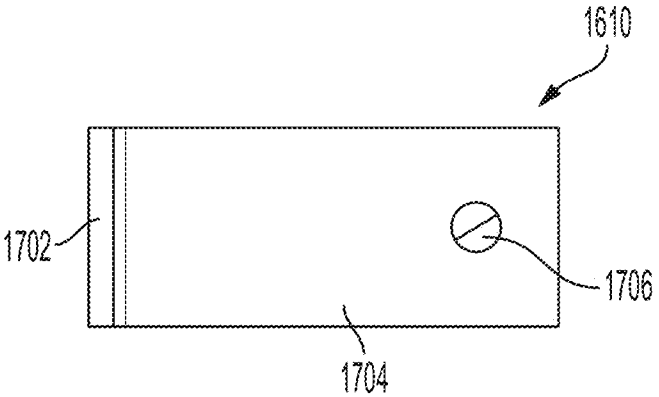
Figure 17A:
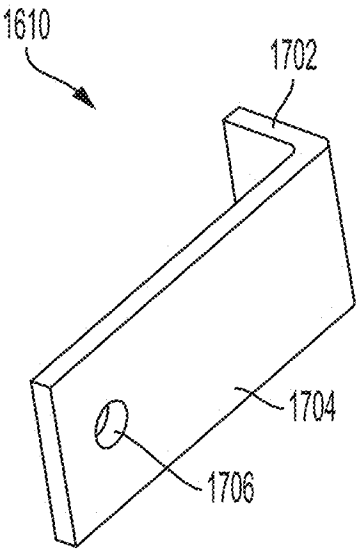
Figure 18B:
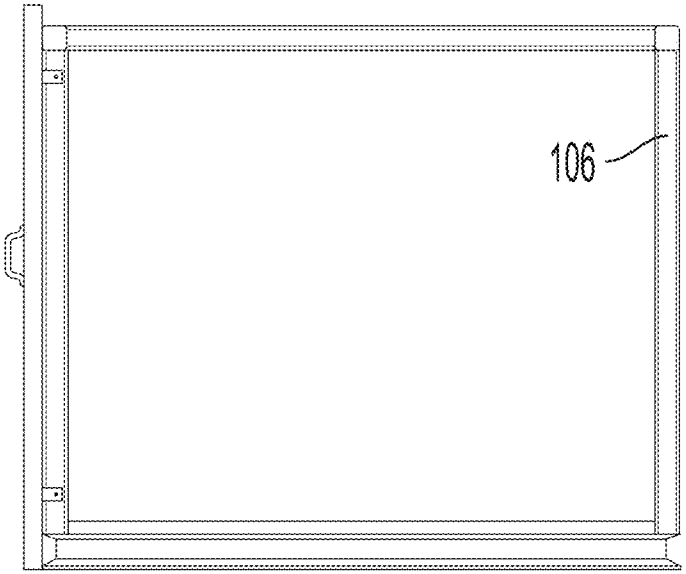
FIGS. 18A and 18B show side views of a module with a removable wall uninstalled and installed, respectively, according to various embodiments described below.
Figure 18A:
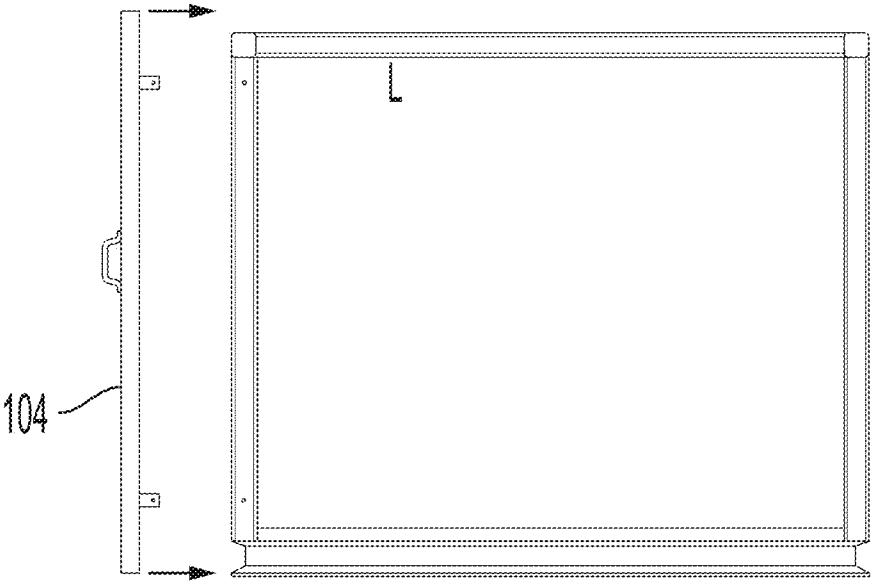

FIGS. 17A-17C show perspective, top, and front views, respectively, of a locking tab 1610 used to secure the removable wall 104 to the module 106 according to one embodiment. The locking tabs 1610 may be configured as an L-shaped bracket or component having a first member 1702 and a second member 1704. The locking tabs 1610 may be manufactured from any suitable metal or material and may have any shape or configuration suitable to secure the weight of the removable wall 104 in place on the module 106. The locking tabs 1610 may be secured to the removable wall 104 and/or the module 106 with appropriate bolts or fasteners using apertures 1706. Additionally or alternatively, the locking tabs 1610 may be welded or otherwise secured in place. For example, the first member 1702 of a locking tab 1610 may be welded to the removable wall, while mechanical fasteners are used to secure the removable wall 104 to the module 106 to facilitate removal of the wall when desired. FIGS. 18A and 18B show side views of a module with a removable wall uninstalled and installed, respectively.

It is contemplated that one or more similar removable walls 104 may be used to provide exterior walls or ceilings when one or more modules 106 are utilized without a shipping container 102. In other words, when modules 106 are used within a shipping container 102 to create a facility, the walls and ceiling of the shipping container 102 become the walls and ceiling of the facility for restricting access through one or more sides of each module. However, when modules are connected together outside of a shipping container 102 to create a facility, removable walls 104 are used as the walls and ceiling of the facility for restricting access through one or more sides of each module. It should be appreciated that the removable walls 104 may be configured differently according to the function of the removable wall 104. For example, the removable wall 104 may be sized, shaped, and configured with or without doors and openings according to use within a shipping container 102, or to create walls or a ceiling when the modules 106 are used to create a facility without a shipping container 102.

Figure 19:
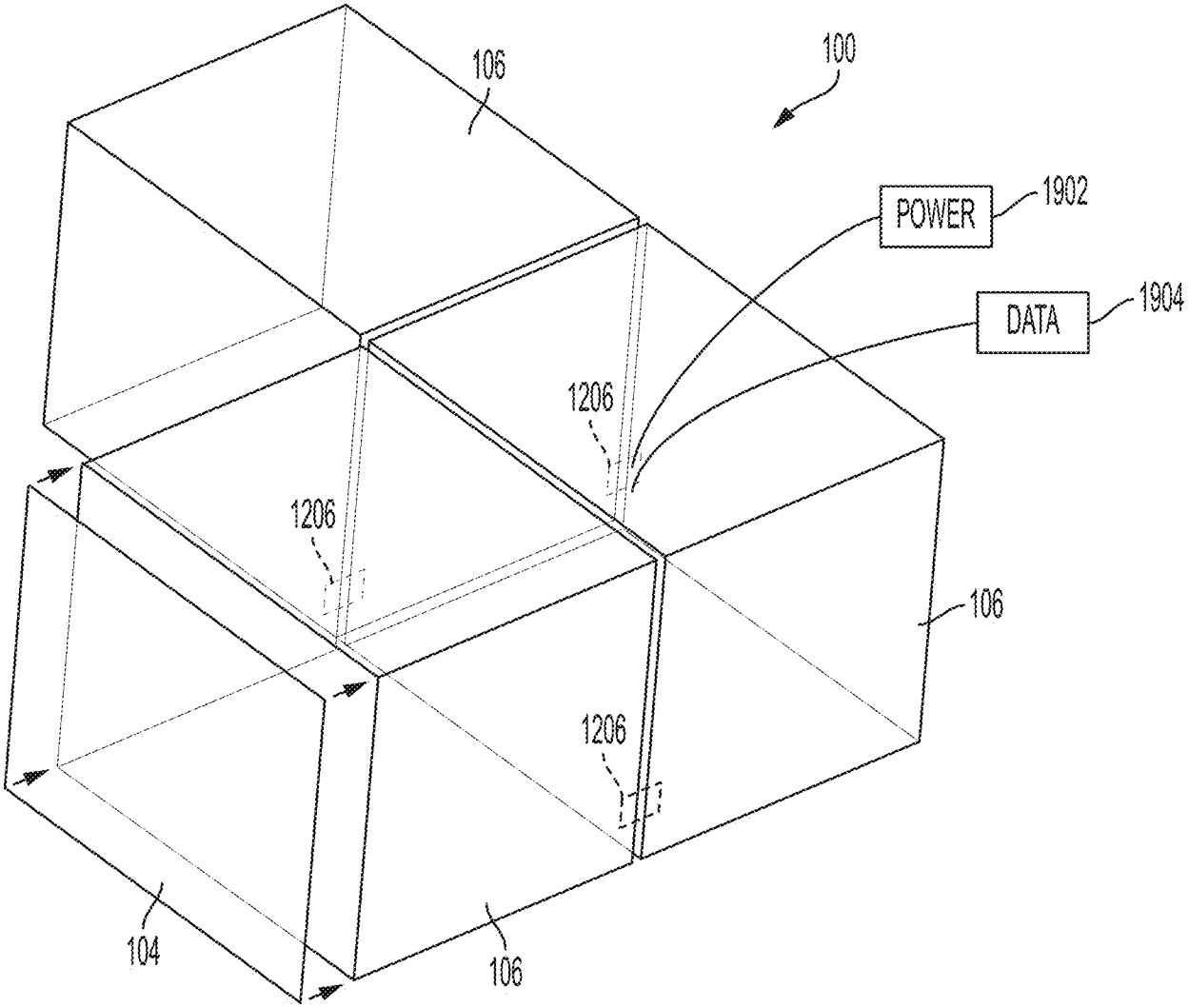
FIG. 19 shows a perspective view of a facility created without a container by coupling three modules in a non-linear configuration and utilizing one or more removable walls according to various embodiments described below.

FIG. 19 shows a perspective view of a facility created without a shipping container by coupling three modules 106 in a non-linear configuration and utilizing one or more removable walls 104. The modules 106 may have substantially identical footprints, but varying internal configurations corresponding to a defined function of the room of the facility that the specific module is creating. This example is shown in an L-shaped non-linear configuration to illustrate the manner in which modules 106 may be coupled together along any or all sides to create a facility of virtually any desired dimensions. In these alternative embodiments, the modules 106 may be mated together using locking tabs 1610 or any suitable coupling mechanism in any desired facility configuration. One or more removable walls 104 are then coupled to the appropriate surfaces of the facility to prevent access and exposure from the exterior, as well as providing any desired internal walls and ingress and egress routes. Only one removable wall 104 is shown in FIG. 19 for clarity purposes, but it should be understood that any walls or ceilings, including interior walls, could be created within the facility using removable walls 104.

Adjacent modules may include electrical and/or data connectors 1206 to couple modules together for electrical and/or communicative capabilities. The facility created by the modular facility formation system 100 may utilize an external power source 1902 that is electrically coupled to one of the modules 106, which is then electrically coupled to the other modules 106 of the facility via connectors 1206. Alternatively, one or more modules 106 may include an internal power source 1902. Similarly, the facility may be connected to an external data and/or communications network 1904 via a connector 1206 of one of the modules 106, or a wireless connection between the facility and the data and/or communications network 1904, and/or between modules 106, may be utilized.

Figure 20:
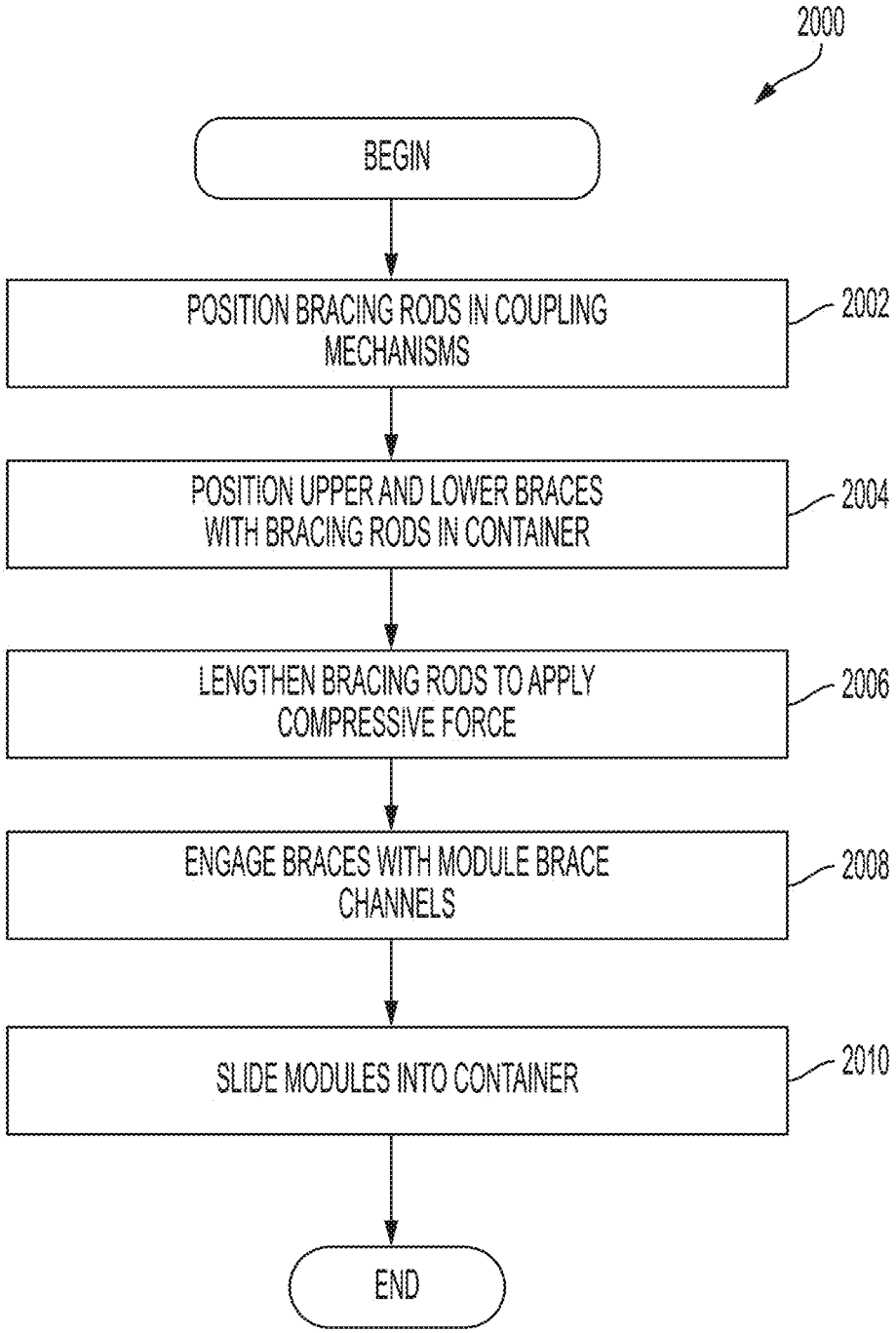
FIG. 20 shows a process diagram for securing a module within a shipping container to create a facility and/or to secure cargo according to various embodiments described below.

FIG. 20 shows an illustrative routine 2000 for securing a module 106 within a shipping container 102. It should be understood that the various operations are not inclusive and may be performed in an alternative order without departing from the scope of this disclosure. According to one embodiment, the routine 2000 begins at operation 2002, where the bracing rods 302 are placed in coupling mechanisms 406 of the front lower braces 402, the rear lower braces 602, and the upper braces 802. The upper and lower braces with the bracing rods 302 are positioned within the shipping container 102 at operation 2004. According to one embodiment, the lower braces are first positioned against the appropriate wall of the shipping container 102, the bracing rods 302 placed in the coupling mechanisms 406 of the lower braces, and the lower braces and bracing rods 302 rotated towards the inside of the container away from the side wall to provide easier access to the tops of the bracing rods 302. The upper braces 802 are then placed on top of the bracing rods 302, engaging the rods with the coupling mechanisms 406 before rotating the upper braces 802, bracing rods 302, and lower braces up against the wall of the shipping container into place.

At operation 2006, the bracing rods 302 are lengthened by rotating one of the rod pieces to extend the rod pieces away from one another using the threaded insert. The bracing rods 302 are lengthened until the compressive force is sufficient to secure the upper and lower braces in place. At operation 2008, the module 106 is moved into a stowage position within the shipping container 102 using a forklift or other lifting mechanism until the module engagement rails 502 of the front lower braces 402 engage or slide into the rail guides 1304 of the modules 106. At operation 2010, the modules 106 are slid into the container 102. A removable wall 104 may be installed if desired.

Figure 21:
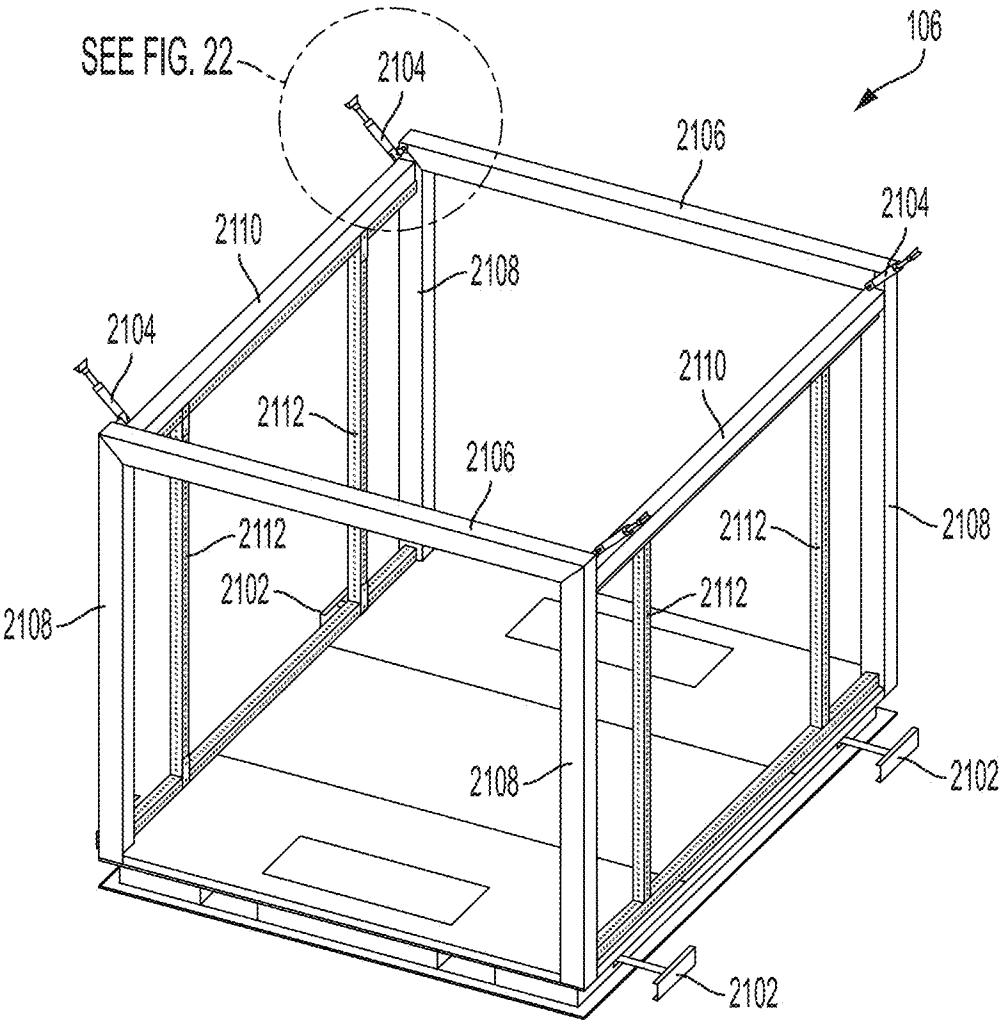
FIG. 21 is perspective view of a module showing a module bracing system according to various embodiments described below.

Turning now to FIG. 21, an alternative embodiment of a module bracing system for securing a module 106 and associated cargo within a container 102 will now be described. According to this embodiment, the module bracing system is positioned within or on the module 106. The module bracing system includes a number of extendable lower braces 2102, extendable upper braces 2104, or a combination thereof. The framework of the module 106 shown in FIG. 21 is similar to the framework 1202 of the modules 106 shown and described above with respect to FIG. 12, with some minor differences. The module 106 of FIG. 21 includes framework having corner vertical members 2108, front and rear horizontal members 2106, and side horizontal members 2110. Vertical support members 2112 provide structural support for the module 106, as well as or alternatively providing attachment means for equipment, furniture, cargo, removable walls, and/or any other components. Any number (including zero), type, orientation, spacing, and positioning of vertical support members 2112 may be utilized without departing from the scope of this disclosure.

According to the example shown in FIG. 21, the module bracing system includes four extendable lower braces 2102, two on each side of the module 106, and four extendable upper braces, each positioned proximate to an upper corner of the module 106. The extendable lower braces 2102 selectively extend outwards from the module 106 to apply pressure to the container walls, securing the module 106 in place within the container, preparing the module 106 and container 102 for shipping and/or for use as a facility. For removal of the module 106 from the container 102, the extendable lower braces 2102 may be retracted toward the module 106 and away from the walls of the container to release the pressure applied by braces and allow for the module 106 to be slid and/or lifted from the container 102.

According to the example implementation shown in FIG. 21, the height of the top surface of the front and rear horizontal members 2106 from the treadplate is greater than the height of the side horizontal members 2110 from the treadplate. In doing so, mounting positions for the extendable upper braces 2104 are created that allow the braces to rotate upward and outward into position for securing the module 106 in the container 102 and to rotate downward and inward into a stowage position against a top surface of the side horizontal members 2110. This stowage position provides a space for the extendable upper braces 2104 that is out of the way of operations within the module 106, below a top surface of the front and rear horizontal members 2106, and within planes defined by outer surfaces of the framework of the module 106 to prevent interference with any attached removable walls.

The module bracing system of FIG. 21 includes four extendable lower braces 2102, two on each side of the module 106, and four extendable upper braces, each positioned proximate to an upper corner of the module 106. The extendable lower braces 2102 selectively extend outwards from the module 106 to apply pressure to the container walls, securing the module 106 in place within the container, preparing the module 106 and container 102 for shipping and/or for use as a facility. For removal of the module 106 from the container 102, the extendable lower braces 2102 may be retracted toward the module 106 and away from the walls of the container to release the pressure applied by braces and allow for the module 106 to be slid and/or lifted from the container 102.

The extendable upper braces 2104 may be used in conjunction with or as an alternative to the extendable lower braces 2102. The extendable upper braces 2104 are rotatable between stowed and extended configurations. In the extended configuration, the upper braces engage a container structure at or proximate to the junction of a container wall and the container ceiling. The extendable upper braces 2104 apply pressure to the container, which secures the module 106 in place or provides support for the top of the module 106 as the container 102 moves during transit.

Figure 22:
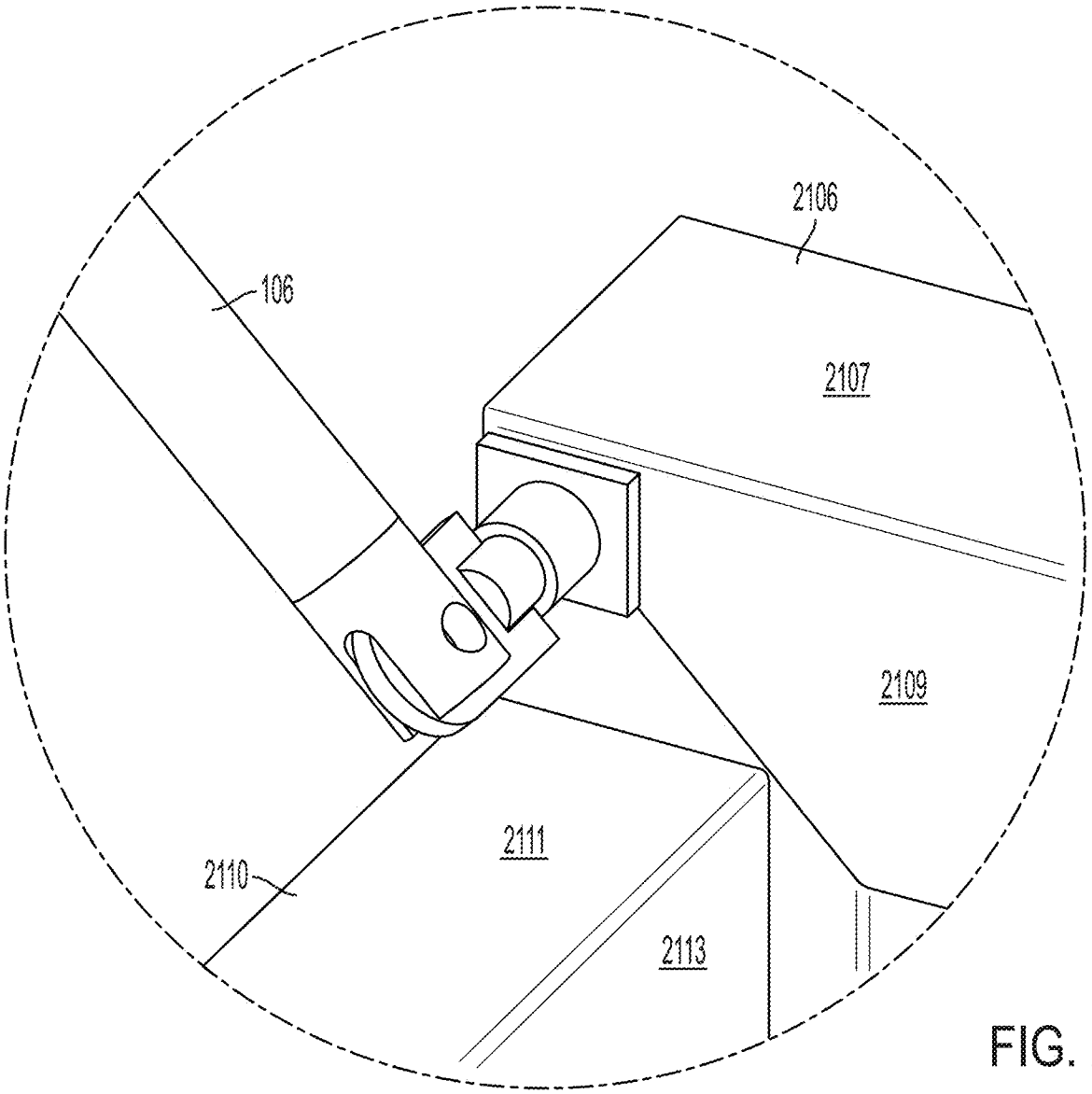
FIG. 22 is an enlarged perspective view of a base end of an extendable upper brace mounted to a module according to various embodiments described below.
Figure 32:
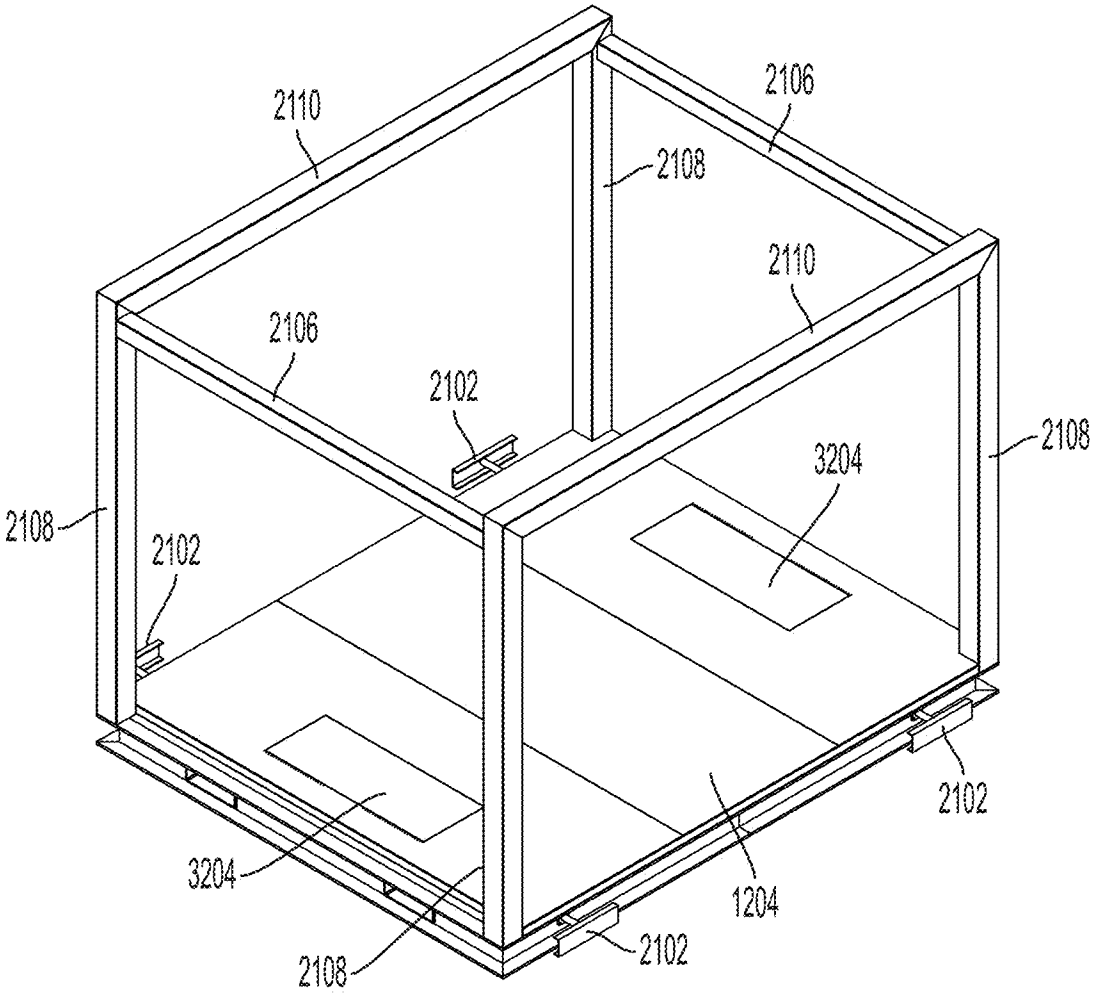
FIG. 32 is perspective view of a module showing extendable lower braces of a module bracing system according to various embodiments described below.
Figure 34:
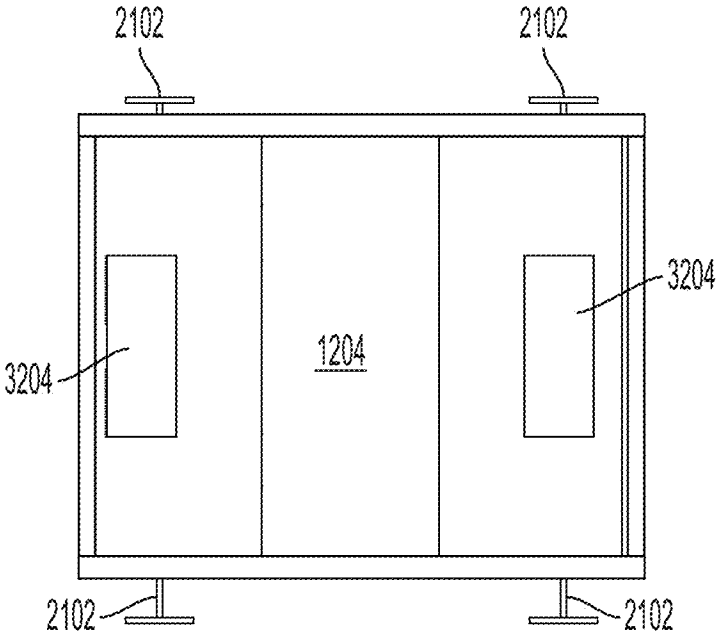
FIGS. 33-35 are front, top, and side views, respectively of the module of FIG. 32 according to various embodiments described below.
Figure 33:
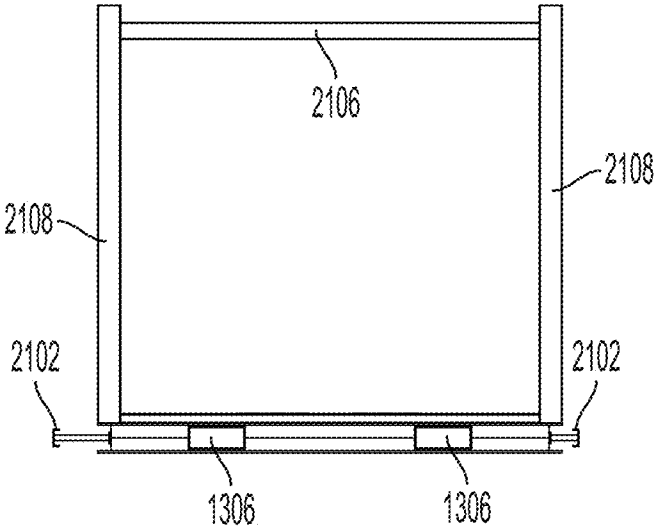

FIG. 22 shows an enlarged view of a base end of an extendable upper brace 2104 mounted to a module 106. In this example, a base end of the extendable upper brace 2104 is mounted to a vertical surface 2109 of a rear horizontal member 2106 in a position that is above the top surface 2111 of the side horizontal member 2110, but below the top surface 2107 of the rear horizontal member 2106. According to other embodiments, as described below with respect to FIG. 32, the extendable upper brace 2104 may be mounted to a vertical surface 2113 of the side horizontal member 2110 when the height of the side horizontal members 2110 is greater than the height of the front and rear horizontal members 2106.

Figure 23:
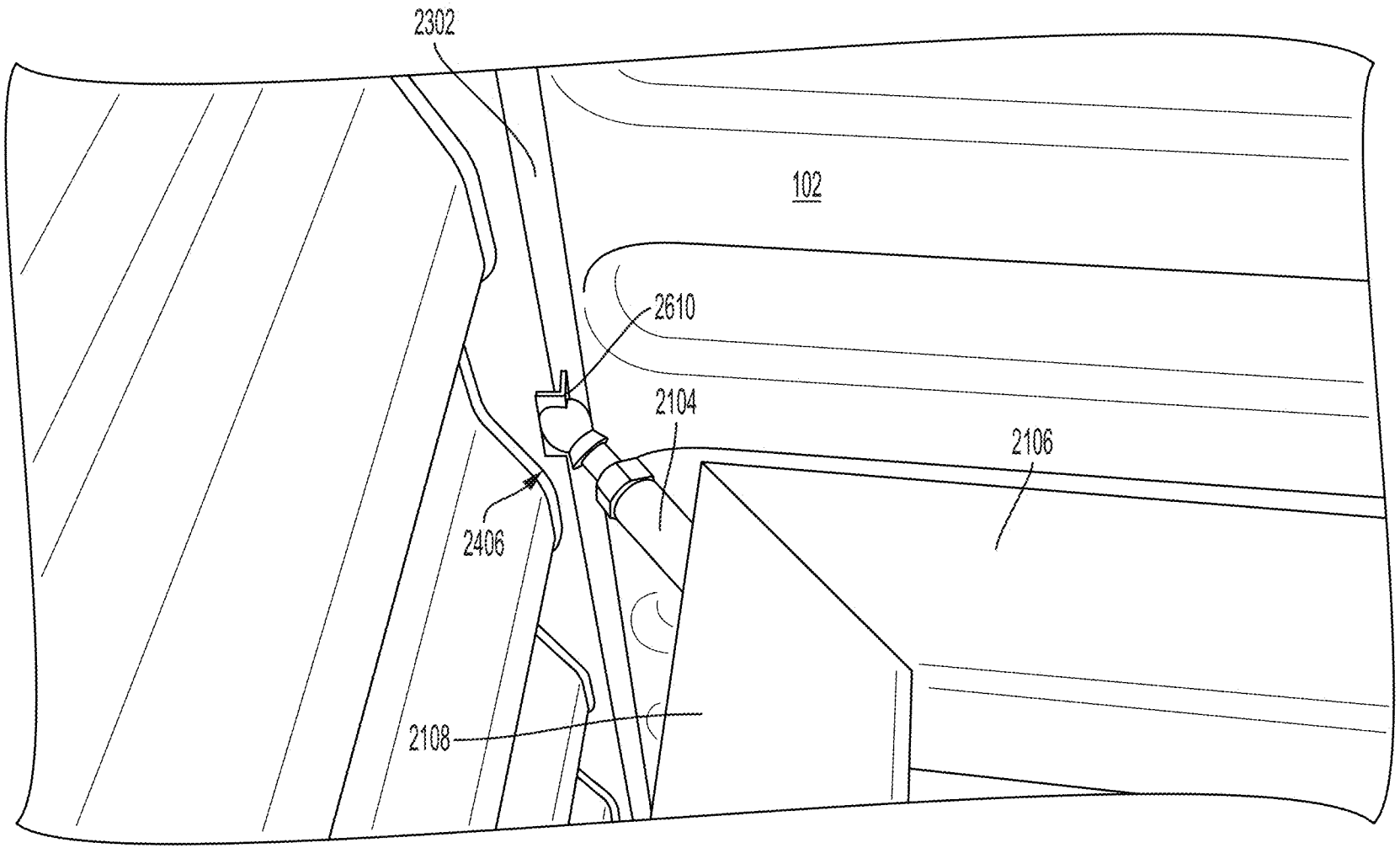
FIG. 23 is a perspective view of a distal portion of an extendable upper brace engaging a container structure according to various embodiments described below.

FIG. 23 is a perspective view of a distal end 2406 of an extendable upper brace 2104 engaging a container structure 2302 of a container 102. In this example, the module 106 is positioned in place within the container 102 and the module bracing system is configured to engage the container 102 and secure the module 106 and corresponding cargo in place. The container structure 2302 may be the edge of a beam that joins a wall and the ceiling of the container 2302. The extendable upper brace 2104 has an angle cap 2610 at the distal end 2406 that is configured to substantially mate with or be complimentary to the shape and configuration of the container structure 2302. According to alternative embodiments, the distal end 2406 of the extendable upper brace 2104 may be shaped, sized, or otherwise configured to engage and apply a force to any corresponding portion of the container 102 in a manner that is suitable to secure the upper portion of the module 106 in place.

Figure 25:
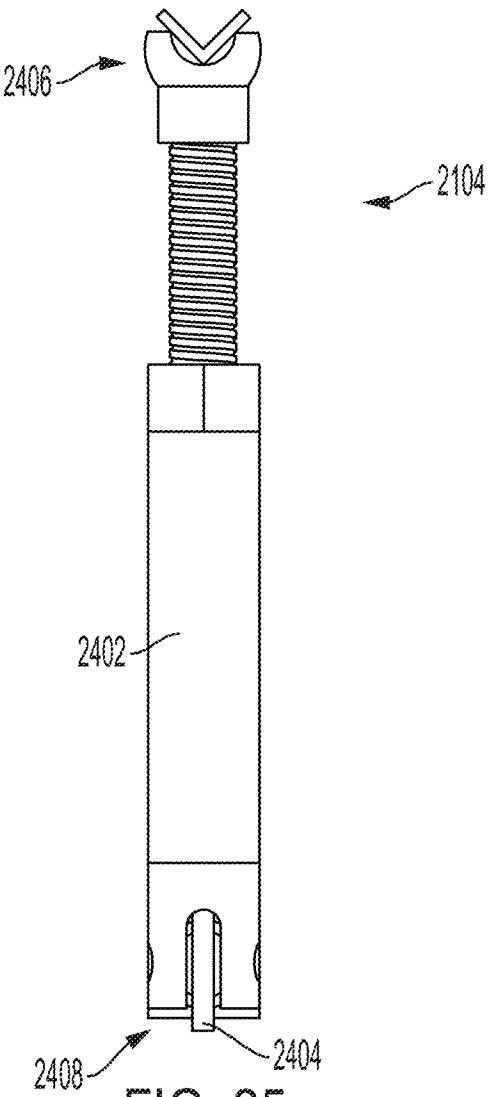
FIGS. 24 and 25 are side and front views, respectively, of an extendable upper brace according to various embodiments described below.
Figure 24:
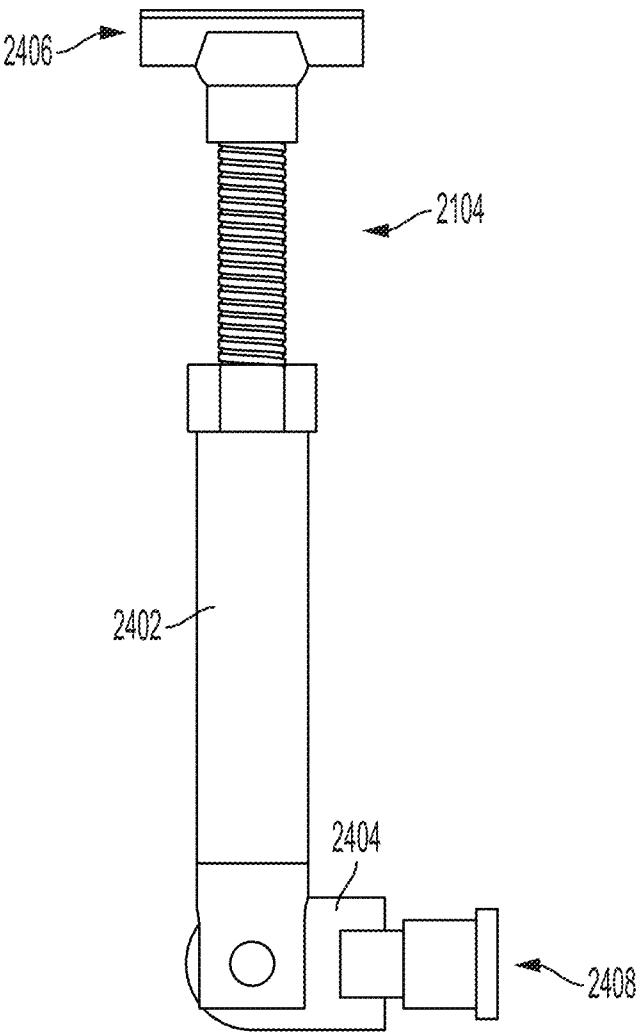

FIGS. 24 and 25 are side and front views, respectively, of an extendable upper brace 2104 according to various embodiments. The extendable upper brace 2104 includes a base end 2408 that is configured to mount to a module 106 and a distal end 2406 that is configured to engage a container structure 2302. The base end 2408 includes a base mount 2404. The base mount 2404 is configured to rotatably connect to a pivotable portion 2402 of the brace. The pivotable portion 2402 is configured to pivot around the base mount 2404 and/or rotate around the base end 2408 of the base mount 2404. The pivotable portion 2402 of the brace pivots from the module 106 towards the container structure 2302. The distal end 2406 is then extended to lengthen the pivotable portion 2402 to engage with and apply a force to the container structure 2302.

Figure 26:
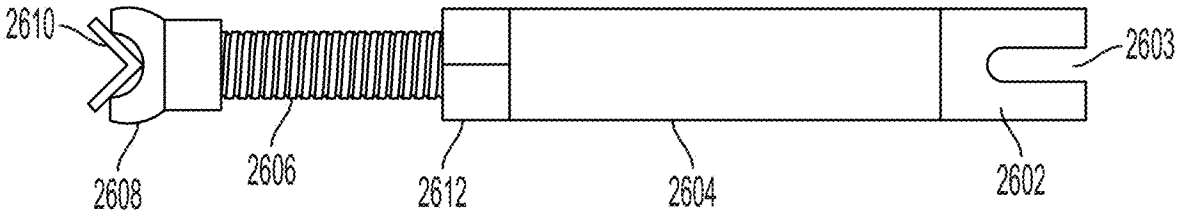
FIG. 26 is a side view of a pivotable portion of an extendable upper brace according to various embodiments described below.
Figure 27:
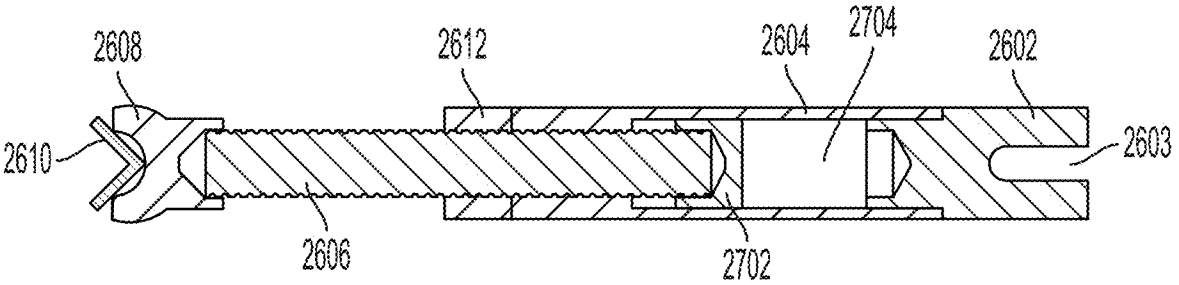
FIG. 27 is a cross-sectional view of a pivotable portion of an extendable upper brace according to various embodiments described below.
Figure 28:
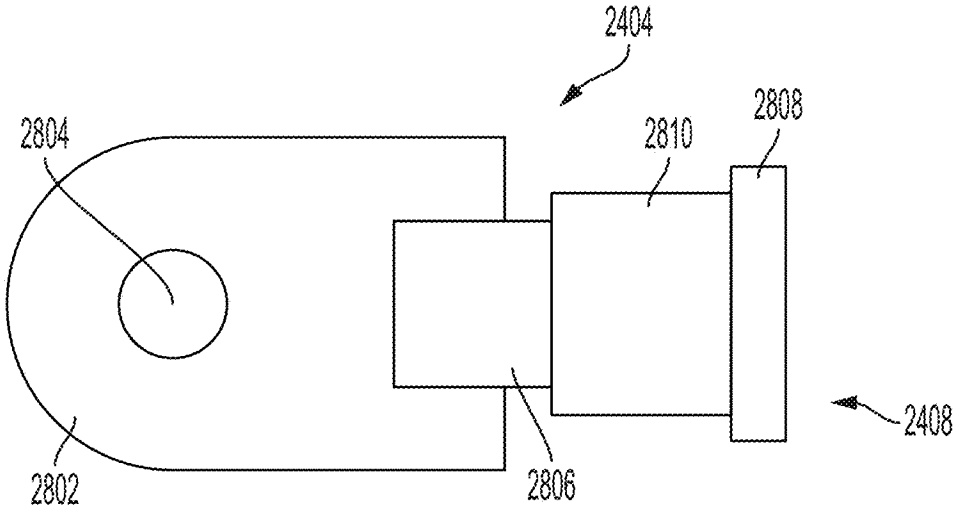
FIG. 28 is a side view of a brace mount of an extendable upper brace according to various embodiments described below.
Figure 30:
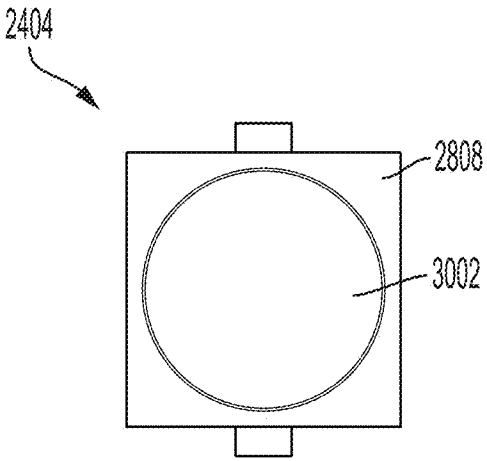
FIG. 30 is a rear view of a brace mount of an extendable upper brace according to various embodiments described below.
Figure 29:
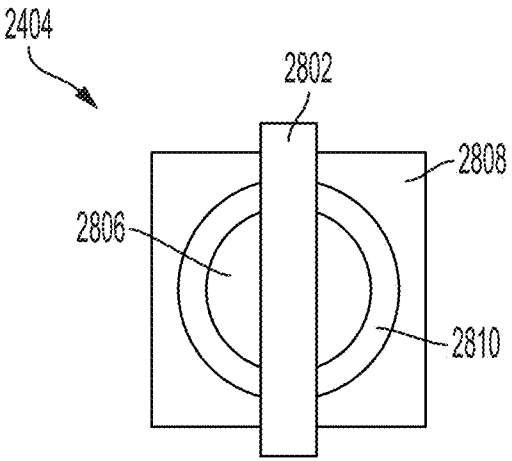
FIG. 29 is a front view of a brace mount of an extendable upper brace according to various embodiments described below.
Figure 31:
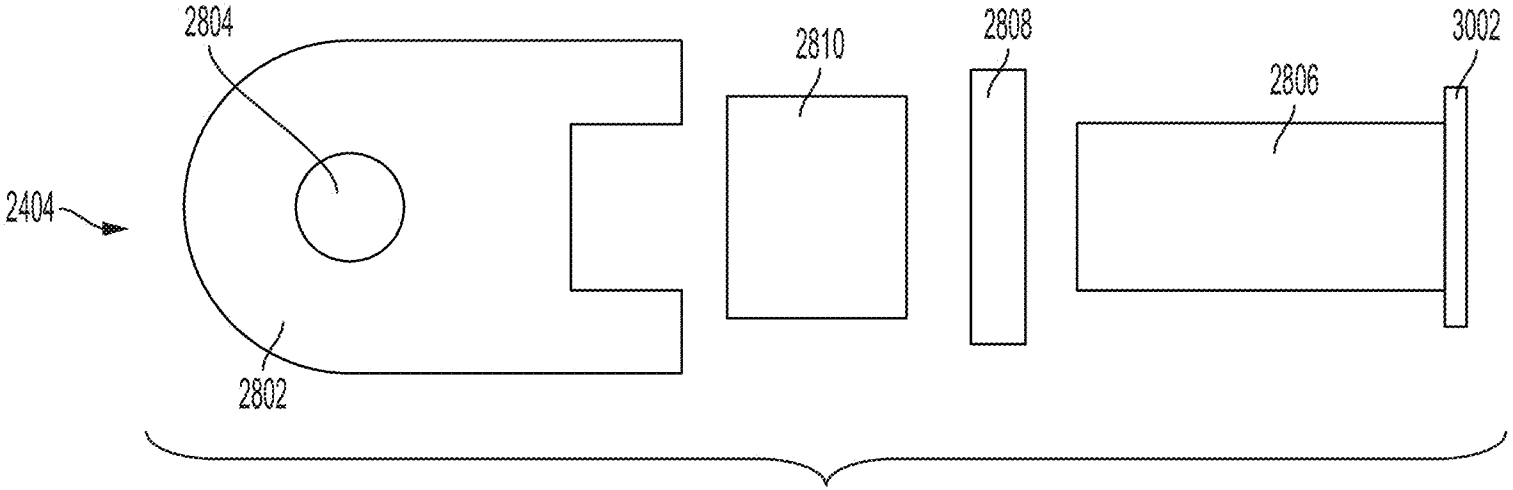
FIG. 31 is an exploded view of a brace mount of an extendable upper brace according to various embodiments described below.

Further details with respect to the pivotable portion 2402 of the extendable upper brace 2104 are shown in FIGS. 26 and 27. FIG. 26 is a side view of the pivotable portion 2402, while FIG. 27 shows a cross-sectional view of the pivotable portion 2402 along a longitudinal axis. According to various embodiments, the pivotable portion 2402 includes a pivoting member 2602, a middle section 2604, a threaded extension 2606, an engagement member 2608, and an angle cap 2610. The pivoting member 2602 provides a slot 2603 for receiving the base mount 2404 and is welded or otherwise fixedly attached to the middle section 2604. As seen in FIG. 27, the middle section 2604 defines a hollow core 2704 that provides a channel through which the threaded extension 2606 and attached guide 2702 linearly translate when extending and contracting. The guide 2702 may be welded or otherwise fixedly attached to the threaded extension 2606. The guide 2702 may be cylindrical or shaped according to the channel of the hollow core 2704.

The threaded extension 2606 may be a threaded rod that is screwed into and out of the middle section 2604 via an actuation mechanism 2612. According to one embodiment, the actuation mechanism 2612 includes a nut that is threaded onto the threaded extension and rests on the middle section 2604. As the nut is turned in one direction, the threaded extension 2606 linearly translates away from the pivoting member 2602 and out of the hollow core 2704 to extend the engagement member 2608 away from the middle section 2604. As the nut is turned in the opposite direction, the threaded extension 2606 linearly translates toward the pivoting member 2602 and into the hollow core 2704 to contract the extendable upper brace 2104.

According to another embodiment, the actuation mechanism 2612 includes a threaded portion of the middle section 2604 that engages the threaded extension 2606. To extend and retract the engagement member 2608, the engagement member 2608, which is welded or otherwise fixedly attached to the threaded extension 2606, may be gripped with a wrench or other tool and manually rotated to rotate and linearly translate the threaded extension 2606 into and out of the middle section 2604. According to yet another embodiment, the actuation mechanism 2612 may include an actuator, motor, hydraulic mechanism, pneumatic mechanism, electromagnetic mechanism, or any other suitable means for extending and contracting the threaded extension 2606. It should be appreciated that the threaded extension 2606 may be configured without threads, if alternative actuation mechanisms are utilized. It should be also be understood that the various components of the extendable upper brace 2104 may be manufactured from any suitable material and according to any suitable shape, size, or dimensions according to the designed forces that are to be applied by the engagement member 2608 to the container structure 2302 and experienced during shipping.

Turning now to FIGS. 28-31, aspects of the base mount 2404 will be described according to various embodiments. FIGS. 28-31 show side, front, rear, and exploded views, respectively of a base mount 2404. The base mount 2404 includes a main body 2802 that is shaped and sized for insertion into and pivoting within the slot 2603 of the pivoting member 2602 described above. The main body 2802 may include a pin aperture 2804 for receiving a pin that traverses through the pivoting member 2602 and the main body 2802 to pivotally couple the components together, while allowing for rotation of the pivotable portion 2402 of the brace around the base mount 2404.

The main body 2802 is welded or fixedly coupled to a body support 2806. The body support 2806 is a cylindrical component having a body support flange 3002. A base sleeve 2810 is welded or fixedly coupled to a base flange 2808. The base sleeve 2810 is a cylindrical tube having an inside diameter that is slightly larger than the outside diameter of the body support 2806. The body support 2806 extends through the base sleeve 2810 until the body support flange 3002 seats within a corresponding recess of the base flange 2808, which prevents the body support 2806 from sliding through the base sleeve 2810. The base flange 2808 is welded or otherwise attached to the framework of the module 106. Once mounted, the main body 2802 and attached pivotable portion 2402 of the extendable upper brace 2104 can rotate around an axis extending through the base sleeve 2810 to assist in deploying or stowing the extendable upper brace 2104. In other words, looking at the front view of the base mount 2404 in FIG. 29, when the base flange 2808 is fixed to the module, the main body 2802 may be rotated clockwise and counter-clockwise. According to various embodiments, bearings may be used to assist rotation.

According to alternative embodiments, the components of the base mount 2404 are fixed and not rotatable. Once mounted to the module 106, the pivotal portion 2402 of the extendable upper brace 2104 can pivot in the slot 2603 around the pin through the main body 2802, but the main body 2802 and attached components cannot rotate around an axis extending through the base sleeve 2810.

The extendable lower braces 2102 will now be discussed with respect to FIGS. 32-39. FIGS. 32-35 are perspective, front, top, and side views, respectively, of a module 106 showing extendable lower braces 2102 of a module bracing system. As discussed above, the extendable lower braces retract into or against the floor system of a module 106 for movement or positioning of the module 106, and extend outward against the side walls of a container 102 to secure the module 106 in place within the container 102 for shipment or for operation as a facility.

It should be noted that the module 106 shown in FIGS. 32-35 are shown without extendable upper braces 2104. The module bracing system may use both extendable upper braces 2104 and extendable lower braces 2102, or may be secured using only the extendable lower braces 2102, as shown here. It should also be noted that the configuration of the framework of the module 106 of FIGS. 32-35 differs slightly than that shown and described above with respect to FIGS. 21 and 22. Specifically, while the module 106 was previously described as having the top surfaces 2107 of the front and rear horizontal members 2106 being higher than the top surfaces 2111 of the side horizontal members 2110, in this example, the top surfaces 2111 of the side horizontal members 2110 are higher than the top surfaces 2107 of the front and rear horizontal members 2106. According to this embodiment shown in FIG. 32, the extendable upper braces 2104 may be mounted to the vertical surfaces 2113 of the side horizontal members 2110.

Figure 36:
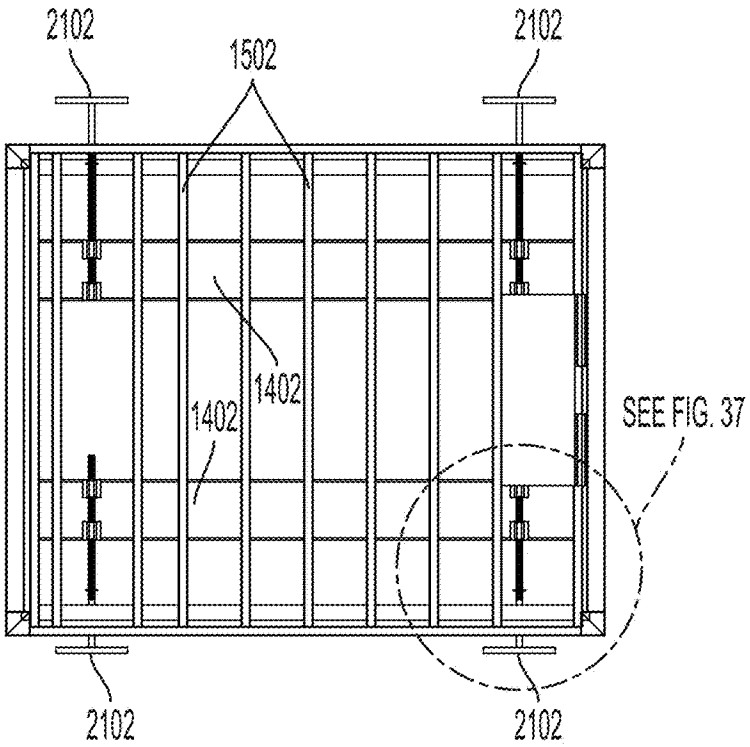
FIG. 36 is top view of a floor system of a module showing extendable lower braces of a module bracing system according to various embodiments described below.
Figure 35:
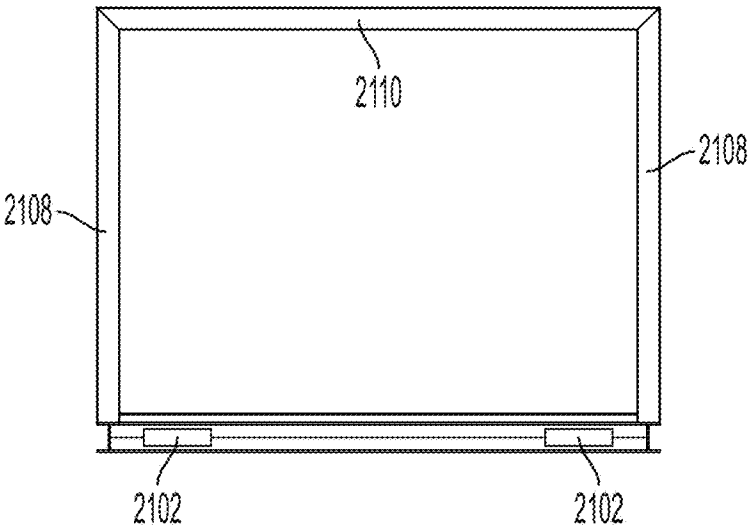
Figure 37:
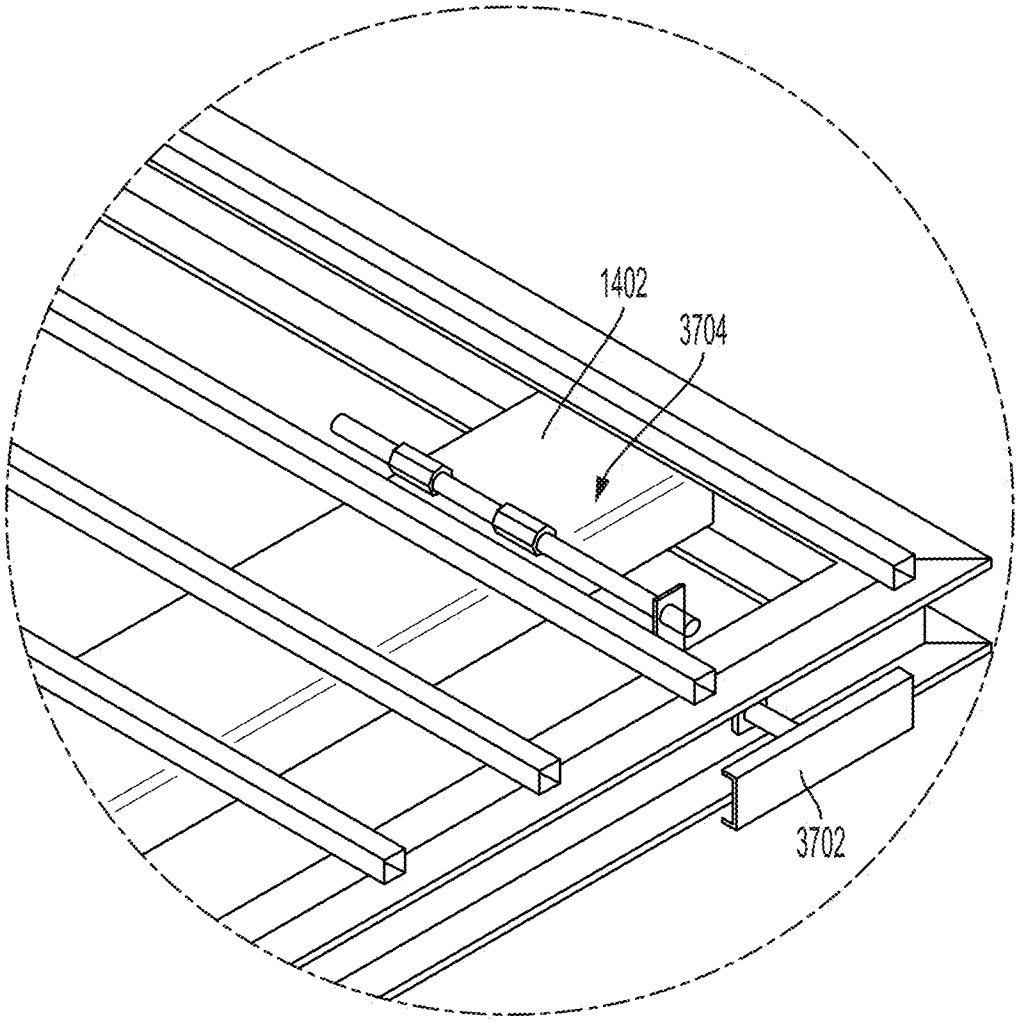
FIG. 37 is an enlarged perspective view of a floor system of a module showing an extendable lower brace according to various embodiments described below.

In these examples, the extendable lower braces 2102 are positioned within the floor system of the module 106, and accessible for extension and retraction via access doors 3204 through the treadplate 1204. FIG. 36 is top view of a floor system of a module 106 showing extendable lower braces 2102 mounted within. As can be seen most clearly in FIG. 37, the extendable lower braces 2102 are mounted to top surfaces of the conduits 1402. Specifically, the extendable lower braces 2102 each include a foot 3702 that is coupled to an extendable rod 3704. Because the top surfaces of the conduits 1402 to which the extendable rod 3704 is mounted are higher than the location at which the foot extends through the rail guide 1304 of the module 106, the foot 3702 is offset downward from the extendable rod 3704.

Figure 38:
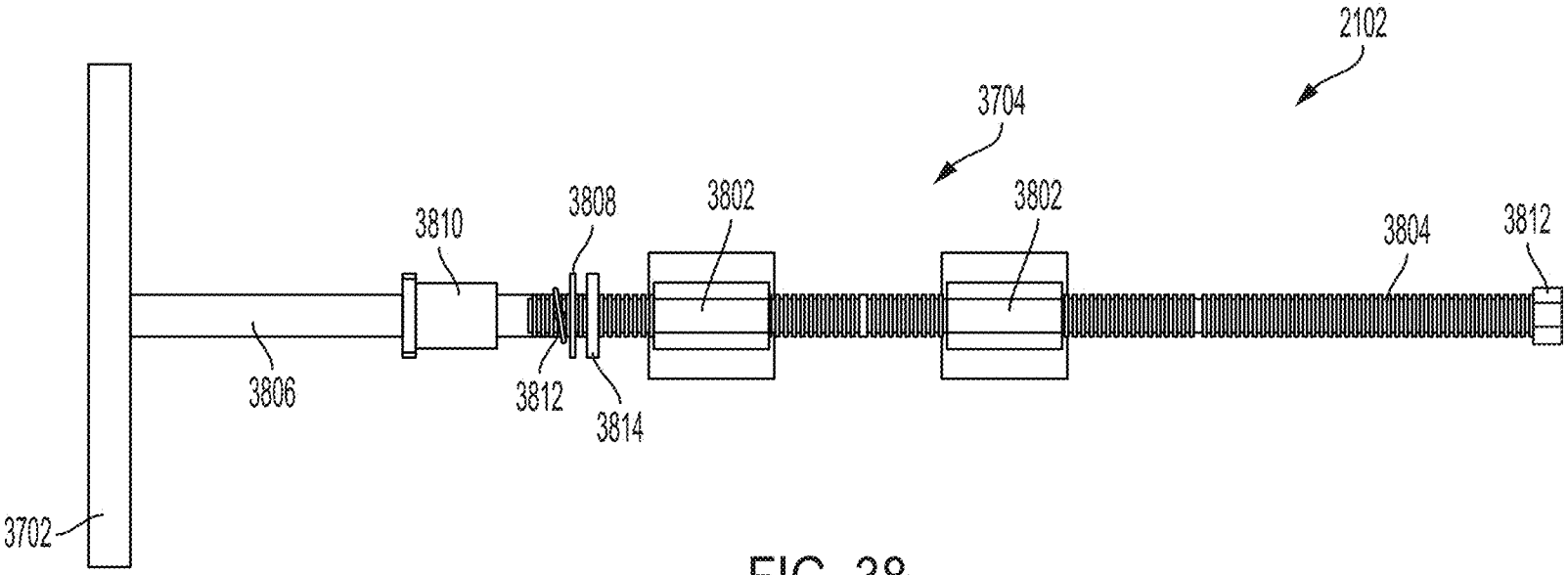
FIGS. 38 and 39 are top and side views, respectively, of an extendable lower brace according to various embodiments described below.
Figure 39:
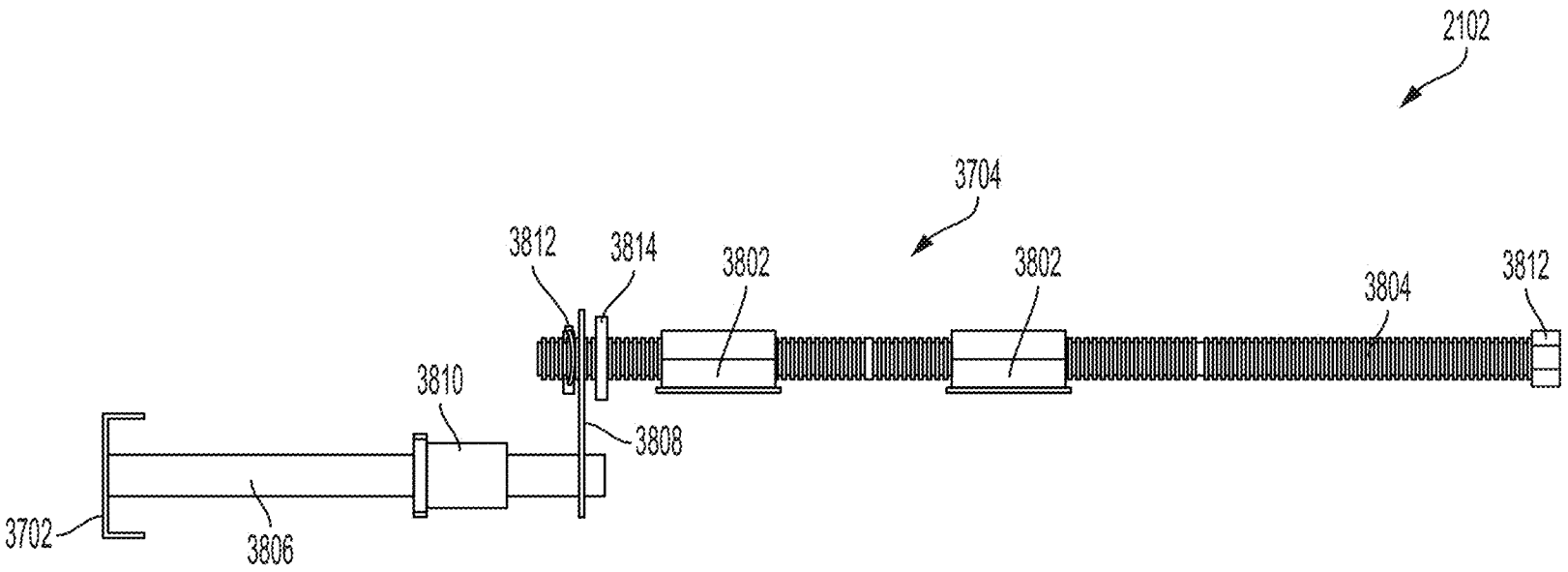

FIGS. 38 and 39 are top and side views, respectively, of an extendable lower brace 2102. The extendable rod 3704 may include a threaded rod 3804 that is routed through one or more nuts 3802, such as hex nuts, to linearly translate the threaded rod 3804 and corresponding foot 3702 outward to engage the side walls of the container 102. According to various embodiments, the extendable lower brace 2102 includes an actuation mechanism that enables the linear translation of the foot 3702 outward toward to the side walls of the container 102 for securing the module 106 in place for shipping and use, and inward toward the module 106 during movement and positioning of the module 106. In this example, actuation mechanism may include a combination of the threads of the threaded rod 3804, the corresponding nuts 3802 that are fixed in place within the floor system of the module 106, and the foot-adjustment nut 3812.

The foot-adjustment nut 3812 is welded or otherwise fixedly secured to the end of the threaded rod 3804 and accessible via the access doors 3204 of the treadplate 1204. The foot-adjustment nut 3812 may be turned with a wrench or other tool in one direction to rotate the threaded rod 3804 and move the rod through the nuts 3802 to extend the foot 3702. Similarly, the foot-adjustment nut 3812 may be rotated in the opposite direction to move the rod back through the nuts 3802 to retract the foot 3702.

The foot 3702 is positioned on the end of a foot support 3806 that traverses through the rail guide 1304 of the module 106. The foot support 3806 may traverse through a linear bearing assembly 3810 to assist extension and retraction through the rail guide 1304. To offset the foot 3702 and foot support 3806 downward from the extendable rod 3704, a bracket 3808 or suitable component is used. The bracket 3808 is fixed to the foot support 3806, providing the desired drop distance corresponding to the positioning of the top surface of the conduit 1402 with respect to the position through which the foot support 3806 traverses through the rail guide 1304. The bracket 3808 is positioned between a fixed stop 3814 and the foot-adjustment nut 3812. The fixed stop 3814 may be welded or otherwise fixedly secured to the threaded rod 3804 at an appropriate position that pushes outward on the bracket 3808 to move the foot support 3806 and corresponding foot 3702 when the foot-adjustment nut 3812 is rotated.

According to alternative embodiments, the actuation mechanism may include one or more actuators, motors, hydraulic mechanisms, pneumatic mechanisms, electromagnetic mechanisms, worm gear, or any other suitable means for extending and contracting the extendable rod 3704. It should be appreciated that the extendable rod 3704 may be configured without threads, if alternative actuation mechanisms are utilized. It should be also be understood that the various components of the extendable lower brace 2102 may be manufactured from any suitable material and according to any suitable shape, size, or dimensions according to the designed forces that are to be applied by the foot 3702 to the container wall and experienced during shipping.

Figure 40:
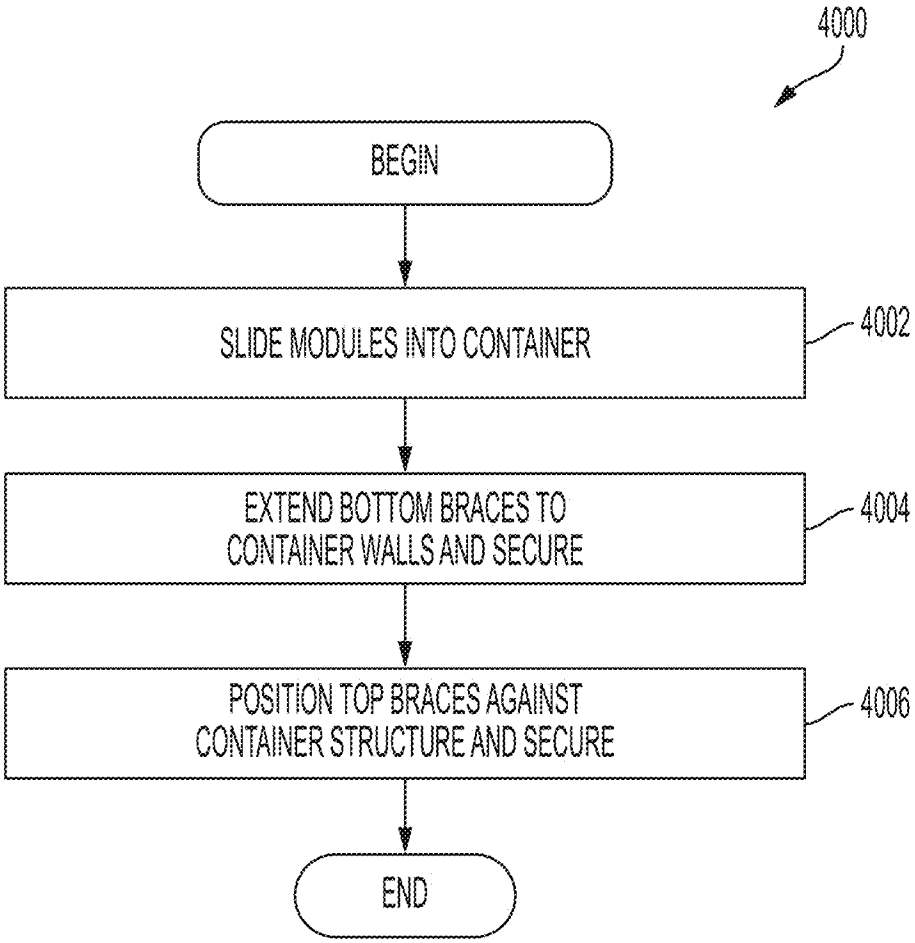
FIG. 40 shows a process diagram for securing a module within a shipping container to create a facility and/or to secure cargo using a module bracing system according to various embodiments described below.

FIG. 40 shows an illustrative routine 4000 for securing a module 106 within a shipping container 102 using the module bracing system disclosed herein. It should be understood that the various operations are not inclusive and may be performed in an alternative order without departing from the scope of this disclosure. According to one embodiment, the routine 4000 begins at operation 4002, where each module 106 is moved into a stowage position within the shipping container 102 using a forklift or other lifting mechanism. At operation 4004, the extendable lower braces 2102 are extended to engage and apply pressure to the container walls, securing the module 106 in place. At operation 4006, the extendable upper braces are rotated into position such that the angle cap 2610 engages the corresponding container structure 2302 and the actuation mechanisms 2612 are manipulated with appropriate tools or other corresponding activation methods to extend the threaded extensions 2606 to apply the appropriate force to secure the modules 106 in place.

CONCLUSION

Many modifications and other embodiments of the disclosure will come to mind to one skilled in the art to which this disclosure pertains having the benefit of the teachings presented in the foregoing descriptions and the associated drawings. For example, as will be understood by one skilled in the relevant field in light of this disclosure, the embodiments may take form in a variety of different mechanical and operational configurations. Therefore, it is to be understood that the disclosure is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

We claim:

1. A modular facility formation system for providing a facility using a container configured for land, sea, or rail transport, the system comprising:

one or more modules, each module having a pre-determined internal configuration that is independent of internal configurations of other modules and comprising:

a framework sized according to an interior space of the container, a floor system coupled to the framework, wherein the framework of each of the one or more modules comprises:

four corner vertical members coupled to four corners of the floor system, a front horizontal member extending between and coupled to a first pair of the four corner vertical members defining a first side of the module, a rear horizontal member extending between and coupled to a second pair of the four corner vertical members defining a second side of the module, two side horizontal members coupled to the four corner vertical members to define a third side and a fourth side of the module, wherein the four corner vertical members and the third and fourth sides of the module are configured for positioning adjacent walls of the container when the module is stowed within the container, and wherein the four corner vertical members, the front horizontal member, the rear horizontal member, the two side horizontal members, and the floor system are fixedly coupled to one another to create a structure that is independent of the predetermined internal configuration; and one or more removable walls configured to selectively restrict access to a module or between modules within the container, while providing at least one door for ingress and egress to the module or between modules, wherein the one or more removable walls are sized to extend substantially between respective side walls of the container.

2. The modular facility formation system of claim 1, wherein the container comprises a shipping container, and wherein the one or more modules comprises two modules positioned within the shipping container adjacent to and abutting one another along the longitudinal axis of the shipping container.

3. The modular facility formation system of claim 1, wherein the floor system comprises:

a plurality of base members defining a base perimeter;

a treadplate abutting at least a portion of the plurality of base members; and a plurality of forklift apertures located within the base perimeter, each configured to receive a tine of a forklift for lifting or relocation of the module.

4. The modular facility formation system of claim 1, each module further comprising one or more connectors configured for electrical or communicative coupling with an adjacent module or an external power source or data network.

5. A modular facility formation system, comprising:

a plurality of modules, each module comprising:

a framework sized according to an interior space of a container, and a floor system coupled to the framework, and one or more connectors configured for electrical or communicative coupling with an adjacent module;

one or more removable walls configured to restrict access to a module or between modules, while providing at least one door for ingress and egress to the module or between modules, wherein the one or more removable walls are sized to extend substantially between respective side walls of the container when coupled adjacent a module within the container; and one or more structures dimensioned and positioned for restricting access through one or more sides of each module, wherein the plurality of modules comprises at least three modules, the at least three modules comprising a first module, a second module, and a third module;

wherein the second module is coupled to the first module along a first side and to the third module along a second side via at least two connectors, wherein the at least three modules share a common power supply, and wherein the at least three modules are non-linearly configured such that the first side and the second side are not opposing.

6. The modular facility formation system of claim 5, wherein the container is a shipping container that is dimensioned to receive the first, second, and third modules into the interior space of the container.

7. The modular facility formation system of claim 5, wherein the one or more structures dimensioned and positioned for restricting access through one or more sides of each module comprises a plurality of removable walls configured for attachment to the one or more sides of the module.

8. The modular facility formation system of claim 5, wherein the at least three modules have substantially identical footprints and varying internal configurations, the varying internal configurations each corresponding to a defined function of a room of a facility.

9. The modular facility formation system of claim 8, wherein at least one of the varying internal configurations corresponds to a storage configuration, a battery charging configuration, a work station configuration, a petroleum oil and lubricant storage and maintenance configuration, a glycol recycling or generation configuration, a milling and machining configuration, a fabrication and welding shop configuration, a small arms repair configuration, a hydraulic fabrication and repair configuration, a mobile water treatment configuration, a mobile solar power facility configuration, or a general maintenance facility configuration.

10. The modular facility formation system of claim 8, wherein at least one of the varying internal configurations corresponds to a battery charging configuration.

11. The modular facility formation system of claim 8, wherein at least one of the varying internal configurations corresponds to a glycol recycling or generation configuration.

12. The modular facility formation system of claim 8, wherein at least one of the varying internal configurations corresponds to a petroleum oil and lubricant storage and maintenance configuration.

13. The modular facility formation system of claim 8, wherein at least one of the varying internal configurations corresponds to a small arms repair configuration.

14. The modular facility formation system of claim 8, wherein at least one of the varying internal configurations corresponds to a mobile water treatment configuration.

15. The modular facility formation system of claim 8, wherein at least one of the varying internal configurations corresponds to a mobile solar power facility configuration.

16. The modular facility formation system of claim 8, wherein at least one of the varying internal configurations corresponds to a battery charging configuration.

17. The modular facility formation system of claim 8, wherein at least one of the varying internal configurations corresponds to a fabrication and welding shop configuration.

18. The modular facility formation system of claim 5, further comprising a guidance mechanism configured to guide the module into a stowage position within the container, wherein the guidance mechanism of each module is configured to engage a plurality of braces removably coupled to an interior of the container to guide the module into the container along a longitudinal axis while preventing movement of the module along a horizontal axis and along a vertical axis.

19. A modular facility formation system, comprising:

a plurality of modules, each module configured to couple to one or more modules of the plurality of modules to create a facility, each module comprising:

a framework, a floor system coupled to the framework, and a pre-determined internal configuration corresponding to a defined function of a room of the facility such that the plurality of modules comprises at least two modules having different pre-determined internal configurations corresponding to at least two different defined functions of at least two rooms of the facility;

one or more connectors configured for electrical or communicative coupling with an adjacent module; and a removable wall configured to restrict access to a module or between modules, while providing at least one door for ingress and egress to the module or between modules, wherein the removable wall is sized to extend substantially between respective side walls of a shipping container that is dimensioned to receive the plurality of modules.

20. The modular facility formation system of claim 19, further comprising:

a plurality of braces configured to:

abut one or more inside surfaces of the shipping container, utilize a compressive force to frictionally engage the one or more inside surfaces of the shipping container and secure the plurality of braces in place, and engage a guidance mechanism of the one or more modules to guide the module into the container along a longitudinal axis while preventing movement of the module along a horizontal axis and along a vertical axis.

* * * * *